US006247902B1

(12) United States Patent
Obayashi et al.

(10) Patent No.: US 6,247,902 B1
(45) Date of Patent: Jun. 19, 2001

(54) TORSIONAL VIBRATION ATTENUATING STRUCTURE IN COMPRESSOR

(75) Inventors: Masakazu Obayashi; Naofumi Kimura; Akira Nakamoto; Kazuhiro Nomura; Hiroyuki Gennami, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/666,201

(22) Filed: Sep. 21, 2000

Related U.S. Application Data

(63) Continuation of application No. 09/198,694, filed on Nov. 24, 1998, now abandoned.

(30) Foreign Application Priority Data

Nov. 28, 1997 (JP) ..... 9-329060

(51) Int. Cl.[7] ..... F04B 49/00
(52) U.S. Cl. ..... 417/223
(58) Field of Search ..... 417/223, 319; 192/842, 210

(56) References Cited

U.S. PATENT DOCUMENTS

| | | |
|---|---|---|
| 1,967,446 | 7/1934 | Meyer . |
| 4,604,539 | 8/1986 | Bertram et al. . |
| 5,219,273 | 6/1993 | Chang . |
| 5,405,296 | 4/1995 | Cerny et al. . |
| 5,560,267 | 10/1996 | Todd et al. . |
| 5,678,460 | 10/1997 | Walkowc . |
| 5,975,860 | 11/1999 | Obayashi et al. . |

FOREIGN PATENT DOCUMENTS

| | | |
|---|---|---|
| 296 00 893 U | 3/1996 | (DE) . |
| 0 668 442 A1 | 8/1995 | (EP) . |
| 55-020908 | 2/1980 | (JP) . |
| 55-20908 | 2/1980 | (JP) . |
| 5-33787 | 2/1993 | (JP) . |

*Primary Examiner*—Teresa Walberg
*Assistant Examiner*—Vinod D Patel
(74) *Attorney, Agent, or Firm*—Woodcock Washburn Kurtz Mackiewicz & Norris LLP

(57) ABSTRACT

A mechanism for attenuating torsional vibration in a compressor is described. The compressor includes a swash plate secured to a drive shaft and pistons coupled to the swash plate. Compression of refrigerant gas by the pistons generates torsional vibrations of the drive shaft. The rear end of the drive shaft is coupled to a damper for attenuating torsional vibrations. The damper includes a frictional plate secured to the rear end of the drive shaft, a weight rotatably fitted about the drive shaft, and a coil spring. The coil spring elastically presses the weight against the frictional plate and elastically couples the weight with the drive shaft. When the drive shaft torsionally vibrates, the weight contacts the frictional plate and is vibrated about the axis of the drive shaft by the coil spring. As a result, energy of the torsional vibrations is consumed and the vibrations are attenuated. Further embodiments show similar dampers attached to the exterior of the compressor.

23 Claims, 20 Drawing Sheets

TORSIONAL VIBRATION ATTENUATING STRUCTURE IN COMPRESSOR

This Application: is a continuation of application Ser. No. 09/198,694 filed Nov. 24, 1998 now abandoned.

BACKGROUND OF THE INVENTION

The present invention relates to a structure for attenuating torsional vibration in compressors employed in, for example, air conditioners for vehicles.

A typical compressor, for example, a swash plate type compressor includes a housing in which a crank chamber is defined. The compressor also has a drive shaft, which extends through the crank chamber and is rotatably supported by the housing. A swash plate is fixed to the drive shaft to integrally rotate with the shaft. A cylinder block, which constitutes a part of the housing, has cylinder bores. A piston is reciprocally housed in each cylinder bore. The pistons are operably coupled to the swash plate and are reciprocated by the rotation of the swash plate. The reciprocation of the pistons compresses refrigerant gas in the cylinder bores.

The drive shaft is coupled to an external drive source such as a vehicle engine by an electromagnetic clutch and a belt. The clutch selectively connects and disconnects the external drive source and the drive shaft. The clutch includes a pulley rotatably supported by the compressor housing, an inner hub secured to the distal end of the drive shaft, an armature facing the pulley, and a solenoid. The armature is coupled to the inner hub by leaf springs and is actuated by the solenoid. The solenoid causes the armature to be pressed against the pulley. In this state, the power of the drive source is transmitted to the drive shaft by a belt, the pulley, the armature, the leaf springs and the inner hub.

During operation of the compressor, the compressing action of the each piston results in a compression reaction force that acts on the drive shaft by way of the piston and the swash plate. The compression reaction acts against the rotation of the drive shaft. The magnitude of the reaction fluctuates periodically. This, in turn, generates torsional vibrations of the drive shaft. When transmitted to the armature by the inner hub and the leaf springs, the torsional vibrations are somewhat attenuated by the leaf springs, which have elasticity. However, since the leaf springs are originally designed to function best as a part of the electromagnetic clutch, the leaf springs cannot attenuate the torsional vibration satisfactory.

The drive shaft, the swash plate and the electromagnetic clutch, which rotate integrally, constitute a rotating body having a natural frequency. A torsional vibration occurs in the rotating body. If the frequency of the torsional vibration is equal to the natural frequency of the rotating body, resonance occurs in the rotating body. The resonance amplifies the torsional vibrations by a great degree. The torsional vibrations also fluctuate the torque acting on the drive shaft and the rotational speed of the pulley. Further, the torsional fluctuations ultimately vibrate other engine accessories that are connected with the compressor by a belt. Accordingly, noise in the passenger compartment is increased.

Strong torsional vibrations cause the armature and the pulley to slide relative to each other, which results in poor transmission of power between the power source and the drive shaft. In order to improve the power transmission, the friction between the armature and the pulley needs to be increased. That is, a larger solenoid needs to be employed. A larger solenoid increases the size of the compressor and manufacturing cost.

Japanese Unexamined Patent Publication No. 55-20908 discloses a compressor having a mechanism for attenuating vibrations. The mechanism is located in an electromagnetic clutch and includes a damper and a connecting plate. The damper and the connecting plate couple an armature to an inner hub. The inner hub and the connecting plate are coupled to each other by springs located in their circumferential portions. The inner hub and connecting plate each have serrated surface facing each other. The damper is located between the serrated surfaces.

Torsional vibrations in a rotating body, which includes a drive shaft, change torque applied to the drive shaft and cause the inner hub to slightly slide relative to the connecting plate. The damper between the inner hub and the connecting plate attenuates the vibrations.

The vibration attenuating mechanism is located in the clutch, more specifically, between the armature and the inner hub, which transmit power. However, it is extremely difficult to design the clutch such that the original function of the clutch, which is to selectively transmit power, is not hindered by the attenuating mechanism. Further, the facing surfaces of the inner hub and the connecting plate are serrated, and the springs are used to couple the inner hub with the connecting plate. The serrated surfaces and the springs complicate the structure of the clutch and increase the number of parts. Accordingly, the manufacture of the clutch is burdensome and costly.

SUMMARY OF THE INVENTION

Accordingly, it is an objective of the present invention to provide a simple mechanism for effectively attenuating torsional vibrations occurred in a compressor.

To achieve the foregoing and other objectives and in accordance with the purpose of the present invention, a compressor having a damper for attenuating torsional vibrations is provided. The compressor has a rotating body, which includes an integrally rotating drive shaft, and a compressing member driven by the rotating body to compress fluid. Compression of fluid causes torsional vibrations of the rotating body. The damper, which attenuates the torsional vibrations of the rotating body, includes a frictional member, a weight and a coupler. The frictional member is provided on the rotating body to integrally rotate with the rotating body and has a frictional surface. The weight has a frictional surface, which contacts the frictional surface of the frictional member to create a predetermined frictional torque resistance between the weight and the frictional member. The coupler elastically connects the weight to one of the rotating body and the frictional member for transmitting rotation and torsional vibrations of the rotating body to the weight. The coupler has elasticity in the direction of the torsional vibrations. The weight contacts the frictional member and vibrates about the axis of the rotating body to cancel the torsional vibrations of the rotating body.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A swash plate type compressor having double-headed pistons according to a first embodiment of the present invention will now be described with reference to FIGS. 1 to 5.

Figure 1:
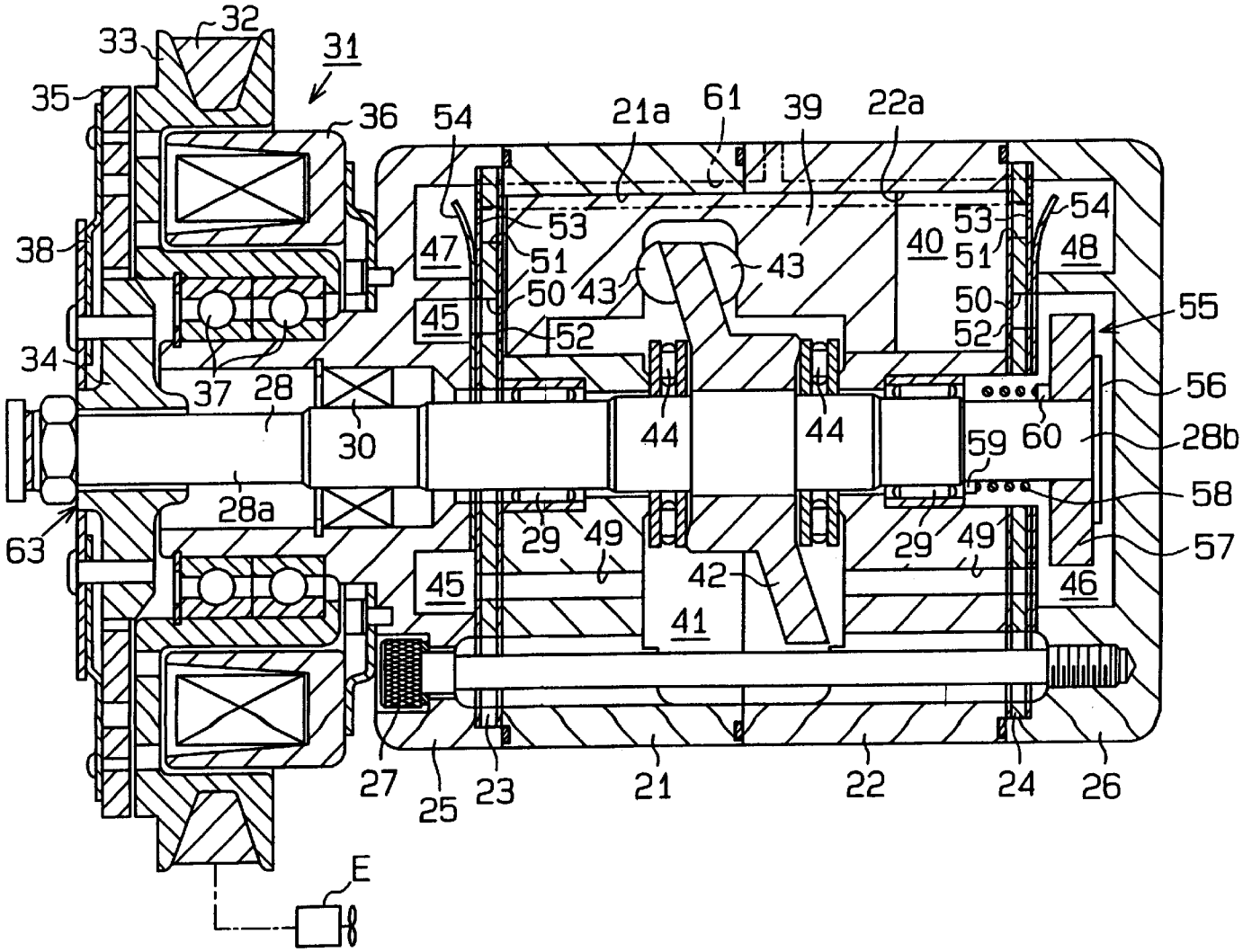
FIG. 1 is a cross-sectional view showing a compressor according to a first embodiment of the present invention.

As shown in FIG. 1, a front cylinder block 21 and a rear cylinder block 22 are coupled to each other at the midsection of the compressor. The front cylinder block 21 has a front end, which is coupled to a front housing 25 by way of a valve plate 23. The rear cylinder block 22 has a rear end, which is coupled to a rear housing 26 by way of a valve plate 24. The cylinder blocks 21, 22, the valve plates 23, 24, the front housing 25 and the rear housing 26 are fastened together by bolts 27 and form a compressor housing.

A drive shaft 28 is rotatably supported by a pair of radial bearings 29 and extends through the center of the cylinder blocks 21, 22 and the front housing 25. The drive shaft 28 has a front end 28*a* projecting from the front housing 25. A lip seal 30 seals the space between the drive shaft 28 and the front housing 25. The front end 28*a* is coupled to the front housing 25 by a clutch 31. The clutch 31 is connected to an external drive source, such as an engine E, by a belt 32 and selectively transmits the power of the engine E to the drive shaft 28.

The clutch 31 includes a pulley 33, an inner hub 34, an armature 35 and a solenoid 36. A support tube is defined at the front portion of the front housing 25. A pair of bearings 37 are fitted on the support tube to rotatably support the pulley 33. The belt 32 is wound onto the pulley 33. The inner hub 34 is fixed to the front end 28*a* of the drive shaft 28. The armature 35 is fixed to the inner hub 34 by leaf springs 38. The solenoid 36 is fixed to the front housing 25 and arranged in the pulley 33 at a position opposing the armature 35. The armature 35 is selectively pressed against and separated from the front face of the pulley 33.

Equally spaced front cylinder bores 21*a* extend through the front cylinder block 21, while equally spaced rear cylinder bores 22*a*, each of which is aligned with one of the front cylinder bores 21*a*, extend through the rear cylinder block 22. Each set of aligned cylinder bores 21*a*, 22*a* is parallel to the axis of the drive shaft 28, and the axes of the bores 21*a*, 22*a* define a circle, the center of which coincides with the drive shaft axis. A compression member, or a double-headed piston 39, having a front head and a rear head is accommodated in each set of cylinder bores 21*a*, 22*a*. A compression chamber 40 is defined between the front head of the piston 39 and the valve plate 23 and between the rear head of the piston 39 and the valve plate 24.

A crank chamber 41 is defined between the cylinder blocks 21, 22. A swash plate 42 is fixed to the drive shaft 28 in the crank chamber 41. The swash plate 42 is coupled to each piston 39 by a pair of semispheric shoes 43. The rotation of the drive shaft 28 causes the swash plate 42 to reciprocate each piston 39. A thrust bearing 44 is arranged between each side of the swash plate 42 and the inner central end of the associated cylinder block 21, 22. In other words, the thrust bearings 44 hold the swash plate 42 between the cylinder blocks 21, 22.

The drive shaft 28, the swash plate 42 and the clutch form a rotating body 63, which has a natural frequency. During operation of the compressor, the compressing action of the each piston 39 results in a compression reaction that acts on the drive shaft 28 by way of the pistons 39 and the swash plate 42. The compression reaction acts against the rotation of the drive shaft 28. The magnitude of the reaction periodically changes. The periodic changes of the reaction magnitude generate torsional vibration of the rotating body 63, which includes the drive shaft 28.

A suction chamber 45 and a discharge chamber 47, which encompasses the suction chamber 45, are defined in the front housing 25. In the same manner, a suction chamber 46 and a discharge chamber 48, which encompasses the suction chamber 46, are defined in the rear housing 26. The suction chambers 45, 46 are each connected to the crank chamber 41 by a suction passage 49, which extends through the associated cylinder block 21, 22 and valve plate 23, 24. The crank chamber 41 is connected to an external refrigerant circuit (not shown) through a compressor inlet (not shown). The discharge chambers 47, 48 are each connected to the external refrigerant circuit by a compressor outlet (not shown) and a discharge passage 61, which extends through the associated cylinder block 21, 22 and valve plate 23, 24.

Suction ports 50 are defined on each valve plate 23, 24 in correspondence with each compression chamber 40 to connect each compression chamber 40 with the associated suction chamber 45, 46. In the same manner, discharge ports 51 are defined on each valve plate 23, 24 in correspondence with each compression chamber 40 to connect each compression chamber 40 with the associated discharge chamber 47, 48. A suction flap 52 is provided for each suction port 50 on the valve plates 23, 24 to close the suction port 50. A discharge flap 53 is provided for each discharge port 51 on the valve plates 23, 24 to close the discharge port 51. A retainer 54 is secured to each valve plate 23, 24 to restrict the maximum opening angle of each discharge flap 53.

Figure 2:
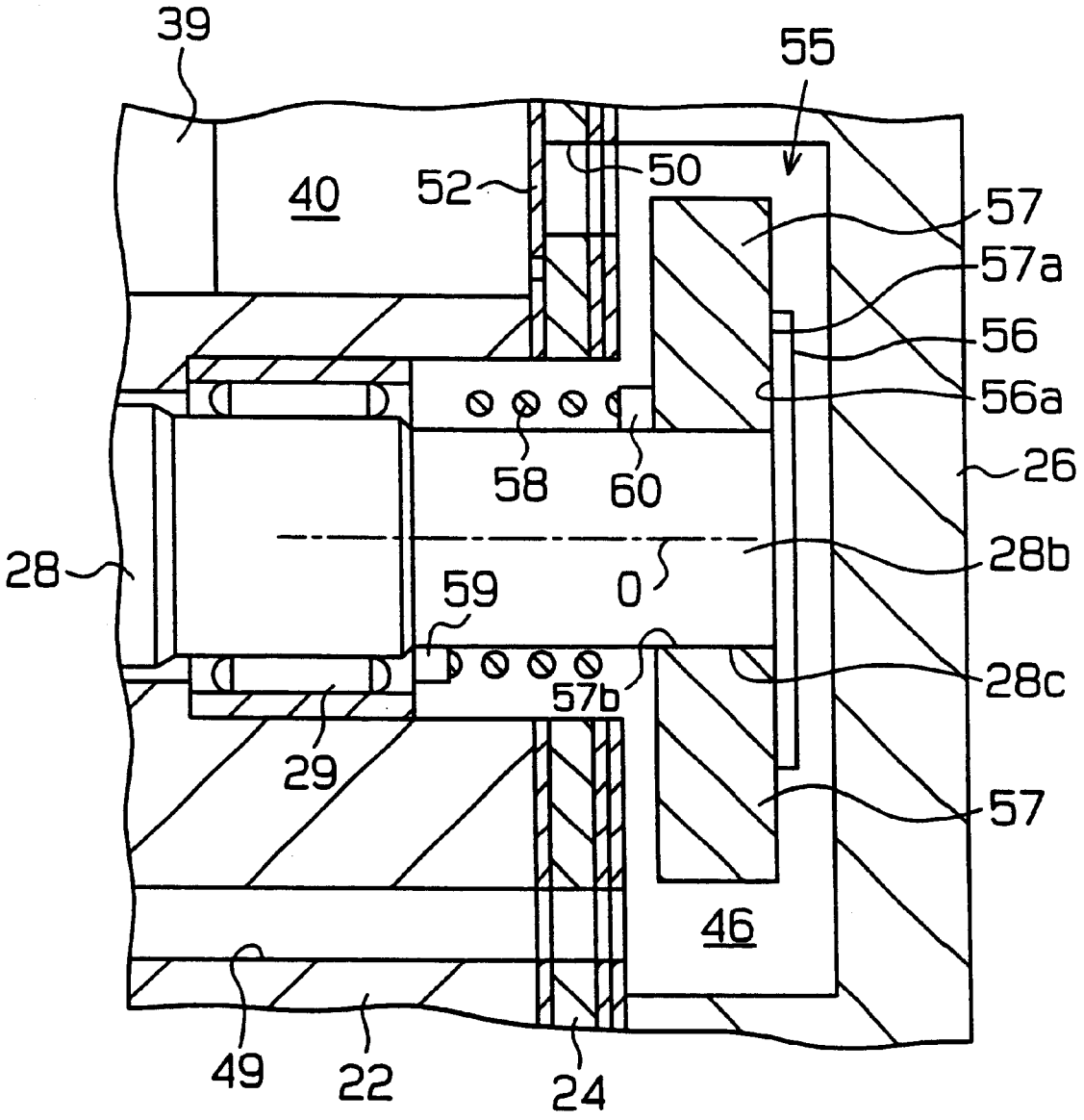
FIG. 2 is an enlarged partial cross-sectional view showing the dynamic damper of FIG. 1.

As shown in FIG. 1 and 2, a damper 55 is provided at the rear end 28*b* of the drive shaft 28 in the rear suction chamber 46 to attenuate torsional vibrations of the rotating body 63. The damper 55 includes a disk-shaped friction plate 56, a ring-shaped weight 57 and a coil spring 58. The friction plate 56 is secured to the rear end of the drive shaft 28 by a bolt (not shown). The weight 57 is fitted about the circumference 28*c* of the drive shaft's rear portion 28*b* to be rotatable relative to the drive shaft 28. The surface of the friction plate 56 that contacts the weight 57 forms a friction surface 56*a*, and surface of the weight 57 contacting the friction surface 56*a* also forms a friction surface 57*a*. The coil spring 58 presses the friction surface 57*a* of the weight 57 against the friction surface 56*a* of the friction plate 56. The friction surface 56*a* lies in a plane perpendicular to the axis O of the drive shaft 28.

The weight 57, which is made of metal such as iron or steel, has a hole 57*b* formed in its center portion. A narrow clearance exists between the hole 57*b* and the surface 28*c* of the drive shaft's rear portion 28*b*. The clearance allows the weight 57 to rotate about the drive shaft 28 and to move axially along the drive shaft 28. However, the clearance does not allow the weight 57 to tilt by any significant amount relative to the plane perpendicular to the axis O.

One end of the coil spring 58 is secured to the drive shaft 28 by a pin 59 and the other end is secured to the front face of the weight 57 by a pin 60. The coil spring 58 not only urges the weight 57 against the friction plate 56 but also elastically couples the weight 57 with the drive shaft 28. In other words, the coil spring 58 has elasticity not only in the axial direction but also in the torsional direction of the rotating body 63. Torsional vibrations of the rotating body 63 are transmitted to the weight 57 by the spring 58 and vibrate the weight 57 about the axis O of the drive shaft 28.

The natural frequency of the damper 55 is determined by the mass of the weight 57 and the modulus of elasticity of the spring 58. In the embodiment of FIGS. 1–5, the mass of the weight 57 and the modulus of elasticity of the spring 58 are determined such that the natural frequency of the damper 55 is substantially equal to the natural frequency of the rotating body 63.

Figure 3:
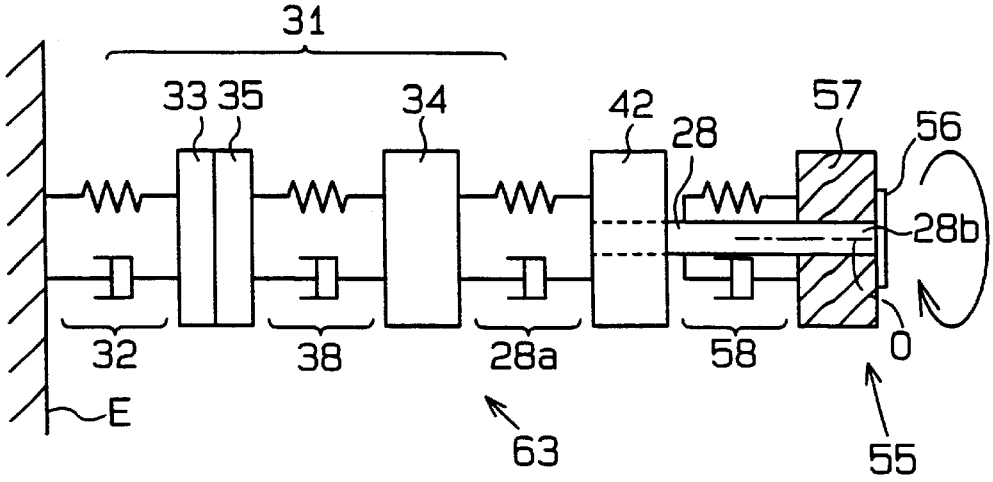
FIG. 3 a schematic diagram illustrating the connection of the drive shaft, the swash plate, the clutch and the damper in the compressor of FIG. 1.
Figure 4:
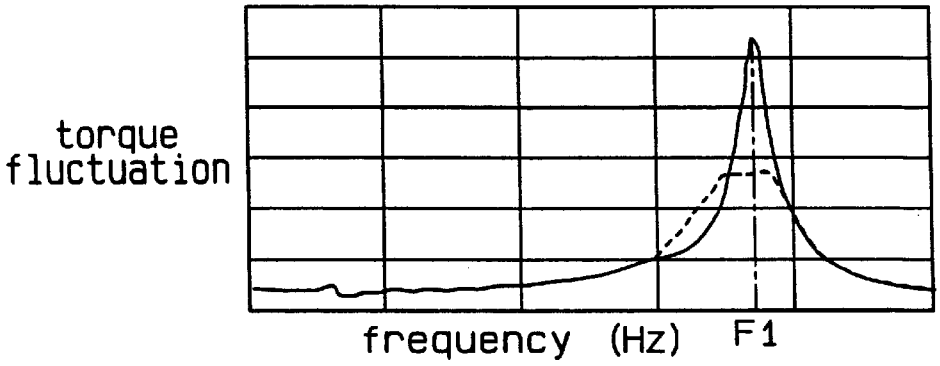
FIG. 4 is a graph showing the relationship between torsional vibration frequency and torque fluctuation of the drive shaft of FIG. 1.

FIG. 3 schematically shows the connection of the drive shaft 28, the swash plate 42, the clutch 31 and the damper 55. Assuming that the engine E is a fixed support, the pulley 33 and the armature 35 are coupled to the fixed support by the belt 32, which acts as an elastic body. The armature 35 is coupled to the inner hub 34 by the leaf springs 38, which act as an elastic body. The inner hub 34 is coupled to the front end 28*a* of the drive shaft 28. A portion of the drive shaft 28 between the inner hub 34 and the swash plate 42 is relatively long. This long portion is elastically deformed in the torsional direction by fluctuation of the compression reaction. Therefore, the front end 28*a* of the drive shaft 28 acts as an elastic body. The swash plate 42 is secured to the middle section of the drive shaft 28. The rear end 28*b* of the drive shaft 28 is fixed to the friction plate 56 and rotatably supports the weight 57. The weight 57 is coupled to the rear end 28*b* of the drive shaft 28 by the spring 58.

The operation of the compressor will now be described.

Power generated by the engine E is constantly transmitted to the pulley 33 of the clutch 31 by the belt 32. Thus, the pulley 23 is rotated constantly when the engine E is operating. When a cooling load is applied to the external refrigerant circuit, the solenoid 36 is excited to attract the armature 35 to the front surface of the pulley 33 against the urging force of the leaf springs 38. This connects the drive shaft 28 to the engine E. When the cooling load applied to the external refrigerant circuit becomes null, the solenoid 36 is de-excited thereby causing the urging force of the leaf spring 38 to separate the armature 35 from the pulley 33. This disconnects the drive shaft 28 from the engine E.

When the drive shaft 28 is rotated by the engine E, the swash plate 42 rotates in the crank chamber 41 and reciprocates each piston 39 in the associated set of cylinder bores 21*a*, 22*a* by means of the shoes 43. The reciprocation of the pistons 39 draws refrigerant gas into the crank chamber 41 from the external refrigerant circuit through the compressor inlet. The refrigerant gas in the crank chamber 41 is then drawn into the associated suction chamber 45, 46 through the suction passages 49. When either head of each piston 39 enters the suction stroke, the head moves from the top dead center to the bottom dead center and decreases the pressure in the associated compression chamber 40. This opens the associated suction flap 52 and draws refrigerant gas into the compression chamber 40 through the associated suction port 50.

As each piston head enters the compression/discharge stroke and moves from the bottom dead center to the top dead center, the refrigerant gas in the compression chamber 40 is compressed to a predetermined pressure. The compressed refrigerant gas then opens the associated discharge flap 53. This discharges the refrigerant gas into the associated discharge chamber 47, 48 through the corresponding discharge port 51. The compressed refrigerant gas is then sent out of the discharge chambers 47, 48 through the discharge passage 61 and the compressor outlet. The external refrigerant circuit includes a condenser, an expansion valve, and an evaporator (none of which are shown), which use the refrigerant gas compressed by the compressor to air-condition the passenger compartment of a vehicle.

During operation of the compressor, the compressing action of the pistons 39 results in compression reactions. The compression reactions fluctuate and thus generates torsional vibrations of the rotating body 63, which includes the drive shaft 28, the swash plate 42 and the clutch 31. Specifically, a relatively long portion of the drive shaft 28 between the inner hub 34 and the swash plate 42 is elastically deformed in the torsional direction by the fluctuation of the compression reactions, which result in the torsional vibrations of the rotating body 63. The torsional vibrations fluctuate the torque applied to the drive shaft 28 and the rotational speed of the pulley 33. As shown by the solid line in the graph of FIG. 4, the torsional vibrations of the rotating body 63 become greatest at frequency F1, which is equal to the natural frequency of the rotating body 63. In the graph, the torque fluctuation of the drive shaft 28 represents the amplitude of the torsional vibrations. When transmitted to the armature 35 by way of the inner hub 34 and the leaf springs 38, the torsional vibrations are somewhat attenuated by the spring 38. The attenuation, however, is not satisfactory.

As the rotating body 63 is torsionally vibrated, the damper 55, which is coupled to the drive shaft 28, vibrates to suppress the torsional vibrations of the rotating body 63. In the embodiment of FIGS. 1–5, the mass of the weight 57 and the modulus of elasticity of the spring 58 are determined such that the natural frequency of the damper 55 substantially coincides with that of the rotating body 63. Thus, torsional vibrations of the damper 55 become maximum at frequency F1 (refer to FIG. 4), at which torsional vibrations of the rotating body 63 becomes maximum. Specifically, vibrations of the rotating body 63 are transmitted to the weight 57 by the spring 58 and vibrate the weight 57 about the axis O of the drive shaft O. The friction surface 57*a* of the weight 57 is pressed against the friction surface 56*a* of the friction plate 56 by the spring 58. Therefore, the vibrations of the weight 57 produce friction between the friction surfaces 57*a*, 56*a*. The vibrations and the friction of the weight 57 consume energy generated by the torsional vibrations of the rotational body 63. In short, the weight 57 vibrates to counteract and cancel the torsional vibrations of the rotating body 63. As a result, the torsional vibrations of the weight 57 lower the torsional vibration peak of the rotating body 63 as shown by the dotted line of the graph of FIG. 4. Consequently, the rotation fluctuation of the pulley 33 is lowered.

Figure 5:
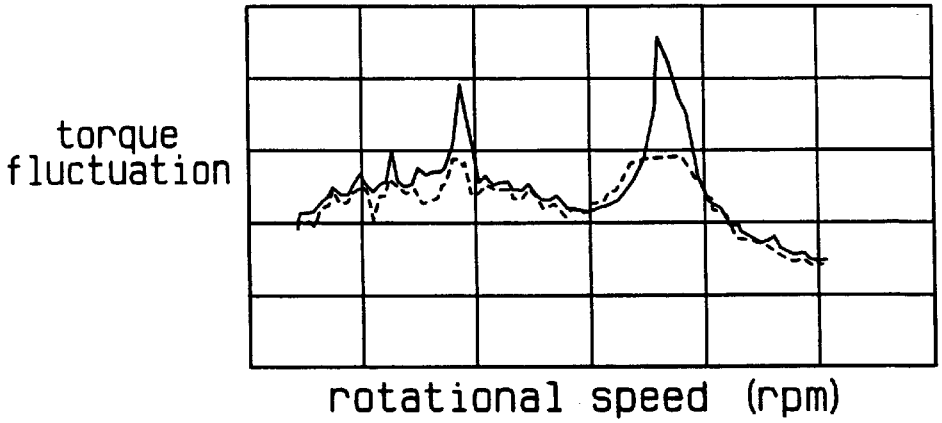
FIG. 5 is a graph showing the relationship between rotational speed of the drive shaft and torque fluctuation of the drive shaft of FIG. 1.

As shown by the solid line in the graph of FIG. 5, torque fluctuation of the drive shaft 28 has peaks at certain numbers of revolution of the drive shaft 28. However, the damper 55 of FIGS. 1 and 2 lowers the peaks of the torque fluctuation as shown by the dotted line in the graph of FIG. 5.

Accordingly, torsional vibration of the rotating body 63, which includes the drive shaft 28, is decreased in an optimal manner. This reliably decreases vibrations and suppresses noise. The decreased torsional vibrations do not cause the armature 35 and the pulley 33 to slide relative to each other when engaged. The power of the engine E is thus positively transmitted to the drive shaft 28. Therefore, there is no need for increasing the size of the solenoid for increasing the friction between the armature 35 and the pulley 33. That is, the size of the solenoid 36 is reduced.

The damper 55 has a simple construction having only the fixed friction plate 56, the rotatable weight 57 and the coil spring 58, which urges the weight 57 against the friction plate 56. Further, the damper 55 is independent from the clutch 31, which adds to the flexibility of the design. Accordingly, the assembly of the compressor is easier and the manufacturing cost of the compressor is lowered.

The friction surface 56*a* of the friction plate 56 is located in a plane perpendicular to the axis O of the drive shaft 28. Further, the weight 57 is rotatable relative to the drive shaft 28 and is not tiltable relative to the drive shaft 28. This construction allows the weight 57 to vibrate only in the rotational direction about the axis O of the drive shaft 28, thereby attenuating torsional vibration. If the weight 57 vibrates in directions other than the rotational direction about the axis O of the drive shaft 28, torsional vibrations would not be effectively suppressed.

The weight 57 is pressed against the friction plate 56, which integrally rotates with the drive shaft 28. Pressing the weight 57 against the compressor housing would result in an increased power loss. However, since the weight 57 does not contact the compressor housing, the embodiment of FIGS. 1–5 does not increase power loss.

The damper 55 is located in the suction chamber 46, the temperature of which remains substantially constant during normal operation of the compressor. The spring 58 is therefore not affected by heat outside the compressor such as heat from the engine E, and the temperature of the spring 58 remains constant. The modulus of elasticity of the coil spring 58, which is affected by temperature, therefore remains constant, and the natural frequency of the damper 55 remains equal to the natural frequency of the rotating body 63. The damper 55 thus positively suppresses the peak of torsional vibrations.

The damper 55 is provided at the rear end 28*b* of the drive shaft 28. This construction allows the damper 55 to be located within the compressor and reduces the size of the compressor. Further, since the damper 55 is located in the suction chamber 46, the damper 55 does not interfere with other parts in the compressor. This adds to the flexibility of the design of the damper 55. Therefore, the characteristics of the damper 55 may be changed to match different types of compressors by simply changing the shape of the damper 55.

The diameter of the weight 57 is preferably large for improving attenuation of vibration. In the embodiment of FIGS. 1–5, the weight 57 is located in the relatively spacious suction chamber 46. This allows the diameter of the weight 57 to be increased while minimizing the mass of the weight 57. In other words, torsional vibrations are sufficiently attenuated by a weight 57 having a minimized mass, since the diameter can be relatively large. Further, reducing the mass of the weight 57 reduces the weight of the compressor.

The spring 58 has two functions, that is, urging the weight 57 against the friction plate 56 and coupling the weight 57 with the drive shaft 28. The use of the spring 58 therefore reduces the number of parts in the compressor and simplifies the construction. As a result, the machining of the parts and the assembly of the compressor are easier.

Other embodiments of the present invention will now be described. The differences from the first embodiment will mainly be discussed below.

Figure 6:
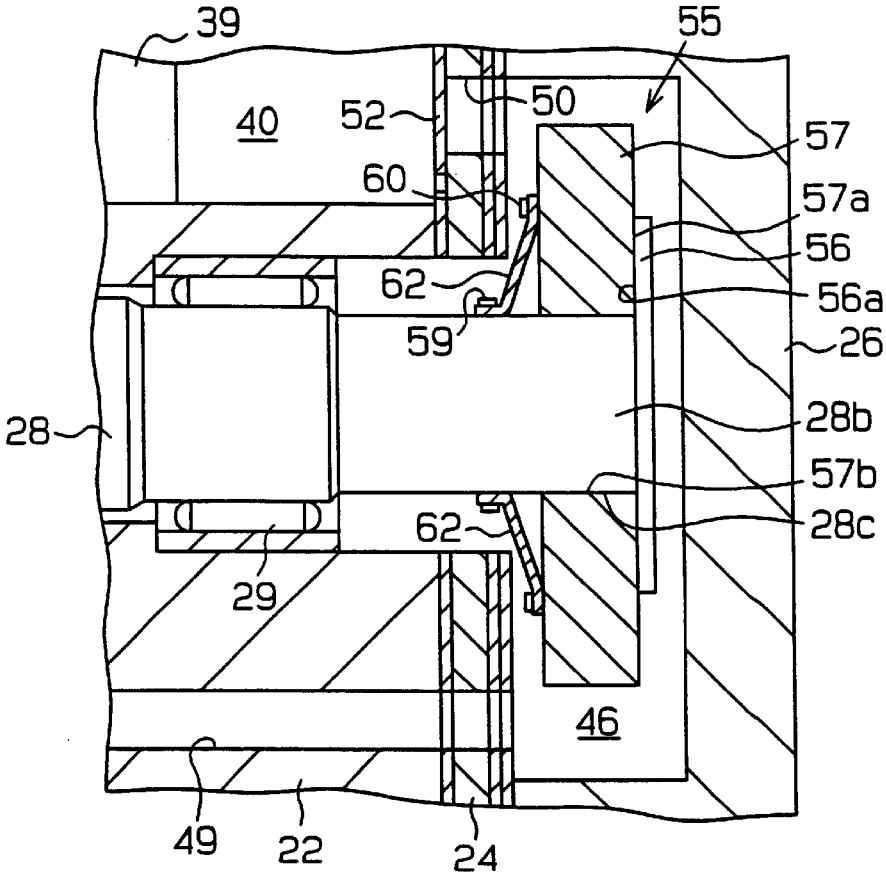
FIG. 6 is an enlarged partial cross-sectional view showing a dynamic damper according to a second embodiment.
Figure 7:
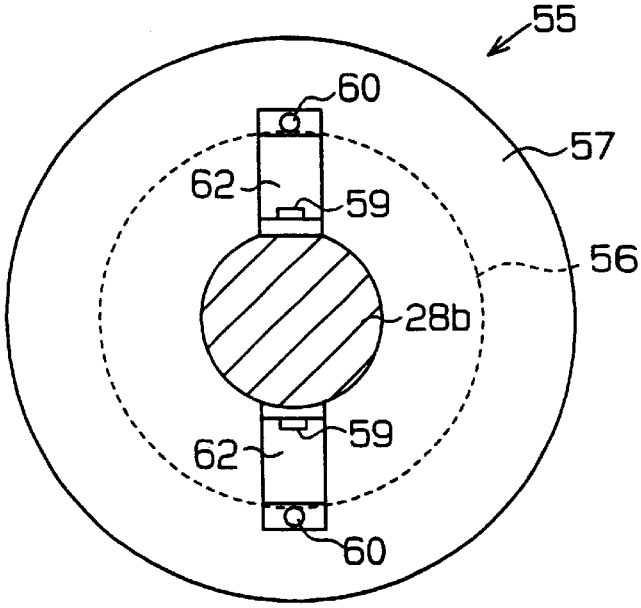
FIG. 7 is a front view of the dynamic damper of FIG. 6.

FIGS. 6 and 7 illustrate a damper 55 according to a second embodiment. Instead of the coil spring 58 of the damper 55 of FIG. 1, the damper 55 of FIGS. 6 and 7 has a pair of leaf springs 62. The damper 55 having the leaf springs 62 has the same advantages as the damper 55 of FIG. 1.

Figure 8:
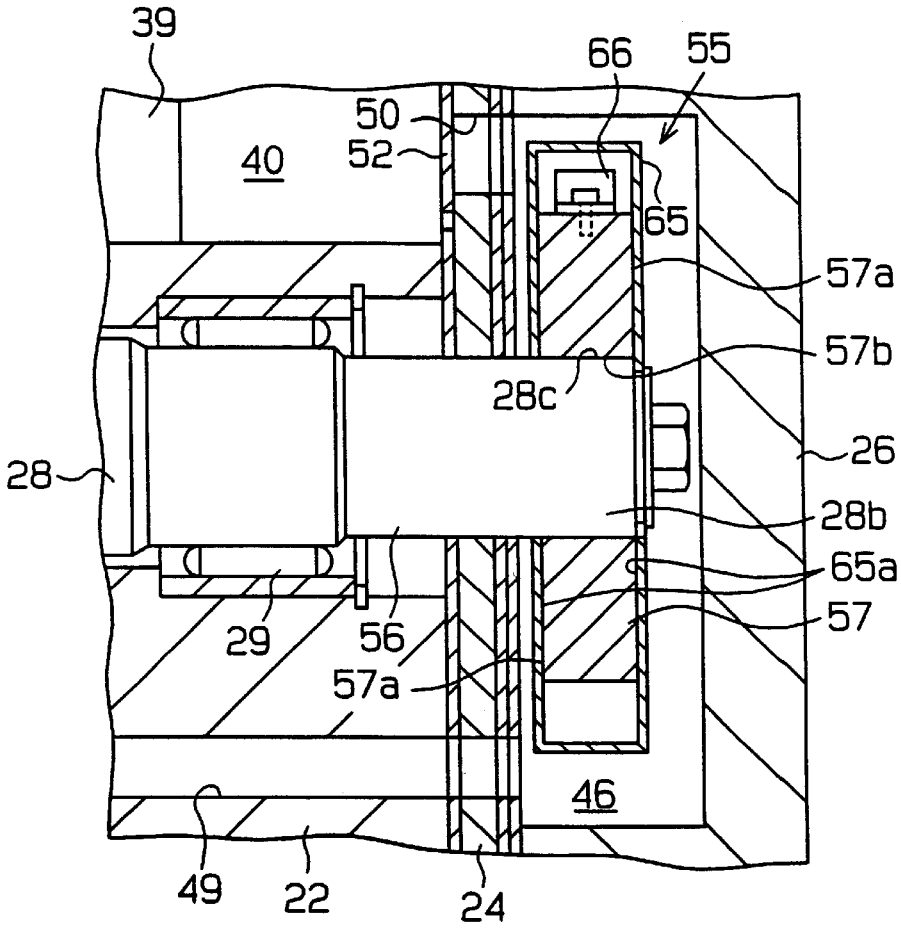
FIG. 8 is an enlarged partial cross-sectional view showing a dynamic damper according to a third embodiment.
Figure 9:
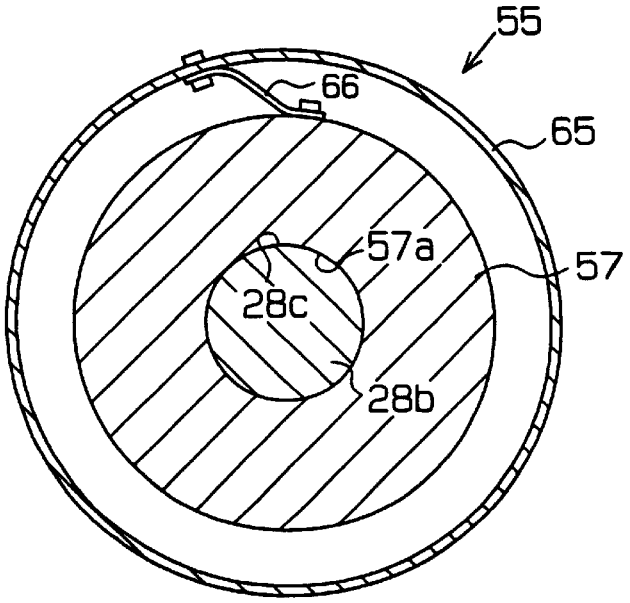
FIG. 9 is a front view showing the dynamic damper of FIG. 8.

FIGS. 8 and 9 illustrate a damper 55 according to a third embodiment. The damper 55 of FIGS. 8 and 9 includes a case 65 for accommodating the weight 57. The case 65 is fitted to the rear end 28*b* of the drive shaft 28. The weight 57 has two friction surfaces 57*a*, one on its front and one on its rear side. The friction surfaces 57*a* contact the inner sides of the case 65 with a predetermined friction force. The case 65 therefore functions like the friction plate 56 of the damper 55 of FIG. 1. The inner sides of the case 65 contacting the weight 57 function as friction surface 65*a*. As shown in FIG. 9, a leaf spring 66 elastically couples the circumferential surface of the weight 57 with the opposing inner surface of the case 65. There may be more than one leaf spring 66. The damper 55 of FIGS. 8 and 9 has the same advantages as the damper 55 of the damper of FIG. 1. Further, the case 65 houses the weight 57. This structure prevents the damper 55 from disturbing refrigerant gas in the suction chamber 46, thereby improving the gas suction performance of the compressor.

Figure 10:
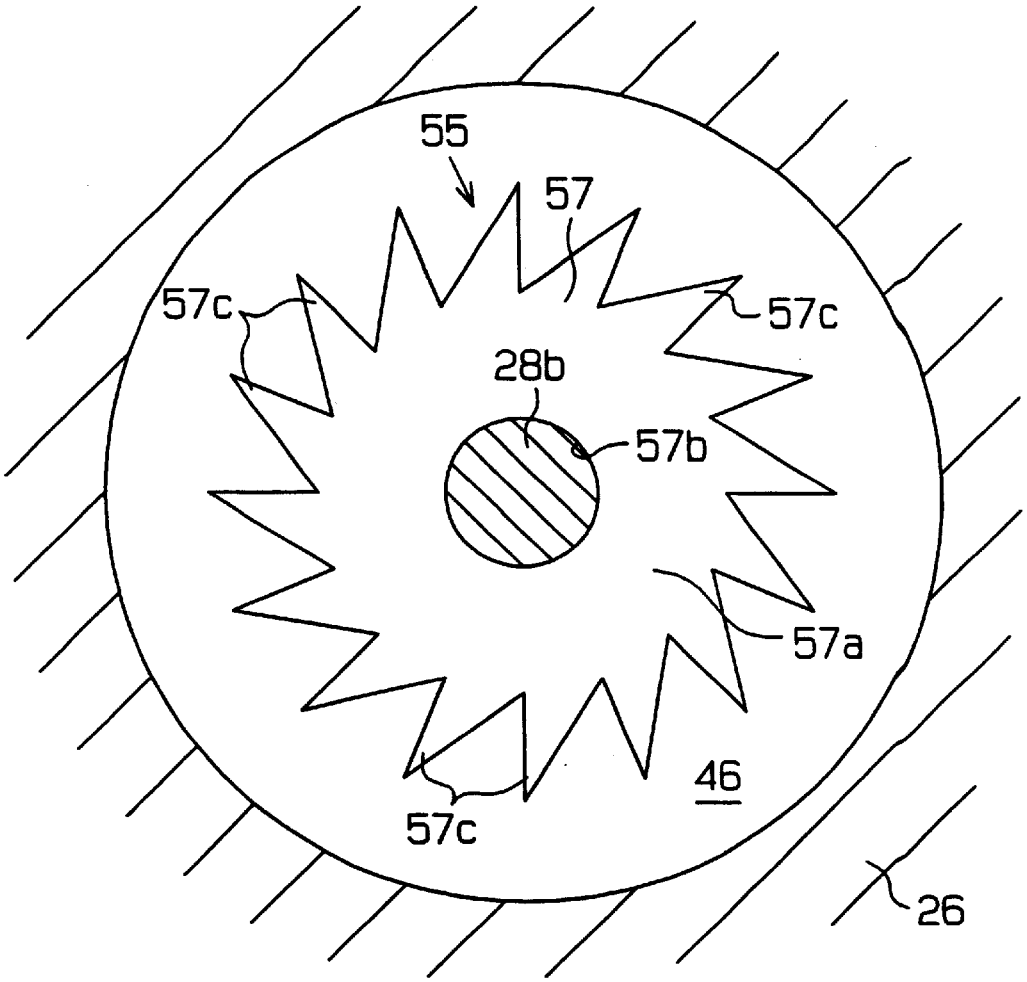
FIG. 10 is a front view showing a dynamic damper according to a fourth embodiment.

FIG. 10 shows a damper 55 according to a fourth embodiment. The damper 55 of FIG. 10 includes an impeller-shaped weight 57 having radially extending blades 57*c*. While rotated, the weight 57 receives resistance from refrigerant gas in the suction chamber. The gas resistance suppresses vibrations of the weight 57, which are generated by torsional vibrations of the rotating body 63. As a result, the torsional vibrations of the rotating body 63 are attenuated. Other shapes of the blades 57*c* have the same advantages. That is, each blade 57*c* may have a rectangular or L-shaped cross-section. Further, each blade 57 may have a recess in its leading side.

Figure 11:
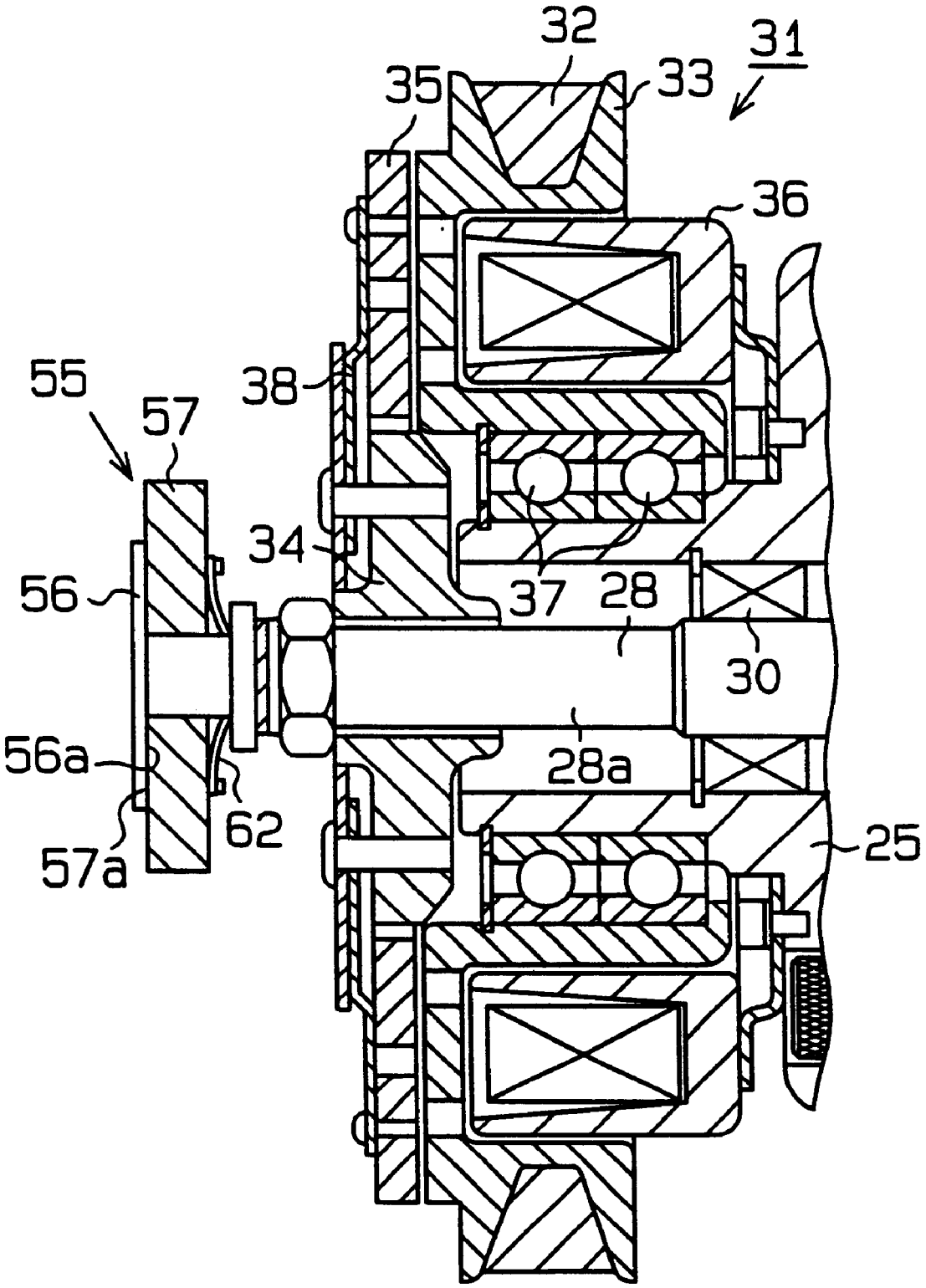
FIG. 11 is an enlarged partial cross-sectional view showing a dynamic damper according to a fifth embodiment.

FIG. 11 shows a damper 55 according to a fifth embodiment. The damper 55 of FIG. 11 is not accommodated in the compressor. Instead, the damper 55 is secured to the front end 28*a* of the drive shaft 28 and is located outside of the compressor. The damper 55 of FIG. 11 has the same construction as the damper 55 of FIG. 6. The damper 55 of FIG. 11 is therefore easily installed on compressors having no inner damper.

Figure 12:
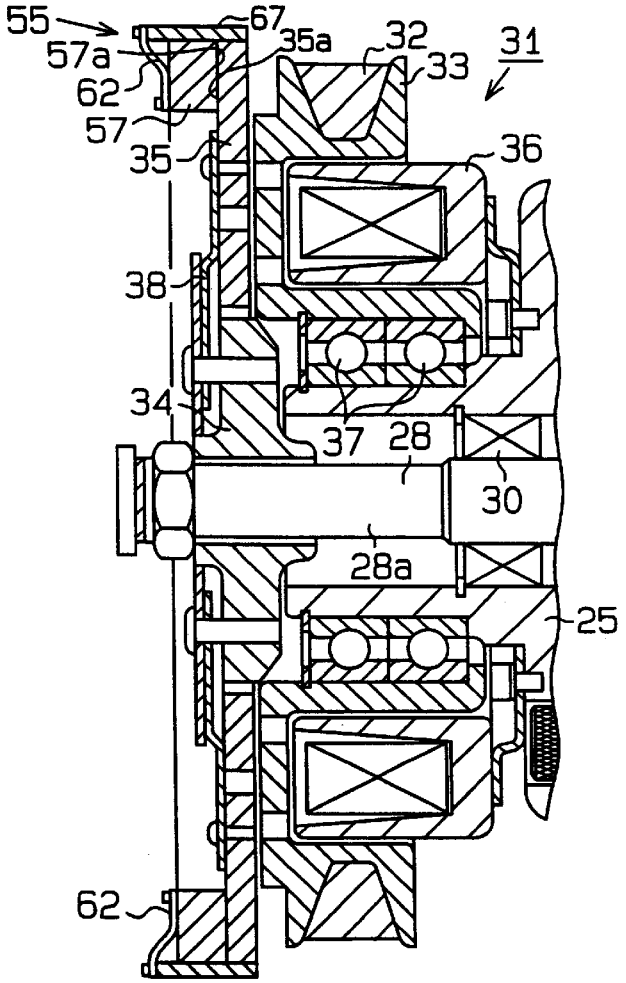
FIG. 12 is an enlarged partial cross-sectional view showing a dynamic damper according to a sixth embodiment.
Figure 13:
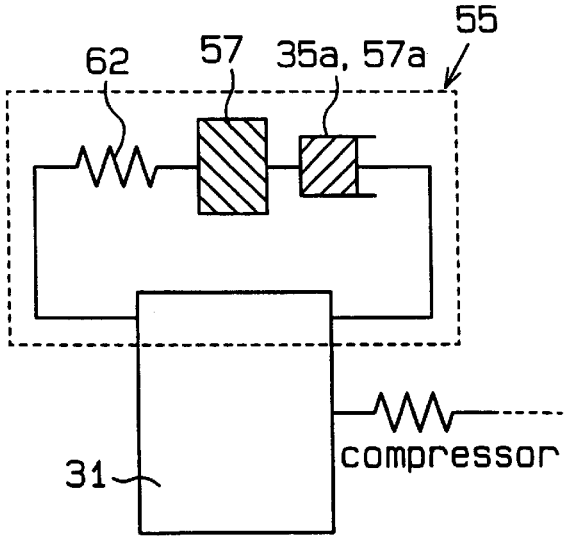
FIG. 13 is a schematic diagram illustrating the damper of FIG. 12.

FIGS. 12–26 show dampers that are assembled to the clutch 31 and are located outside the compressor. FIGS. 12 and 13 illustrate a damper 55 according to a sixth embodiment. The damper of FIGS. 12 and 13 has a ring shaped weight 57 located adjacent to the armature 35. The weight 57 has a friction surface 57*a* contacting the front face of the armature 35. In the damper 55 of FIGS. 12 and 13, the armature 35 functions like the frictional plate 56 of the damper 55 of FIGS. 1 and 2. That is, the front face of the armature 35 forms a friction surface 35*a*. A ring 67 is fixed to the outer surface of the armature 35 to surround the weight 57. The ring 67 prevents the weight 57 from moving axially and from tilting relative to a plane perpendicular to the axis of the drive shaft 28. Leaf springs 62 couple the ring 67 with the weight 57. The springs 62 elastically couple the ring weight 57 with the ring 67 and urge the weight 57 against the friction surface 35*a* of the armature 35. The springs 62 are spaced at equal angular intervals about the axis of the armature 35 and define a circle, the center of which coincides with the armature axis. FIG. 13 schematically shows the damper 55 of FIG. 12.

The damper 55 of FIGS. 12 and 13 is not located midway in the power transmission train of the clutch 31. That is, the damper 55 does not couple the inner hub 34 with the armature 35, but is secured to the armature 35. The damper 55 of FIGS. 12 and 13 is therefore easily installed on the clutch 31 without changing the coupling construction of the leaf springs 38, which couple the inner hub 34 with the armature 35. The damper 55 of FIGS. 12, and 13 therefore does not hinder the function of the clutch 31. Further, the construction of the damper of FIGS. 12 and 13 allows the diameter of the weight 57 to be maximized. The maximized diameter maximizes the vibration suppression characteristics of the damper 55 while allowing the mass of the weight 57 to be minimized.

Figure 14:
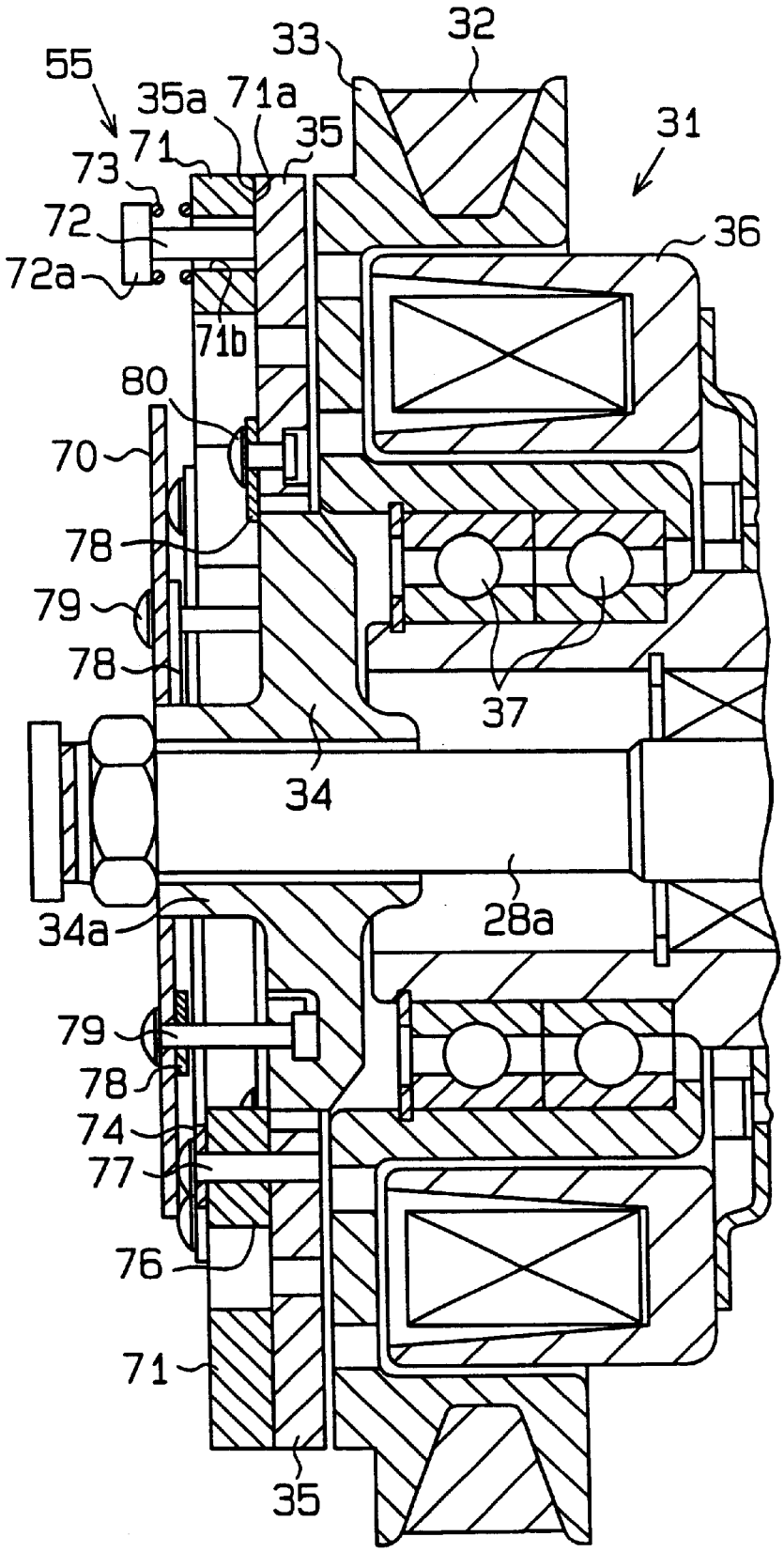
FIG. 14 is a cross-sectional view taken along line 14—14 of FIG. 15 showing a dynamic damper according to a seventh embodiment.
Figure 15:
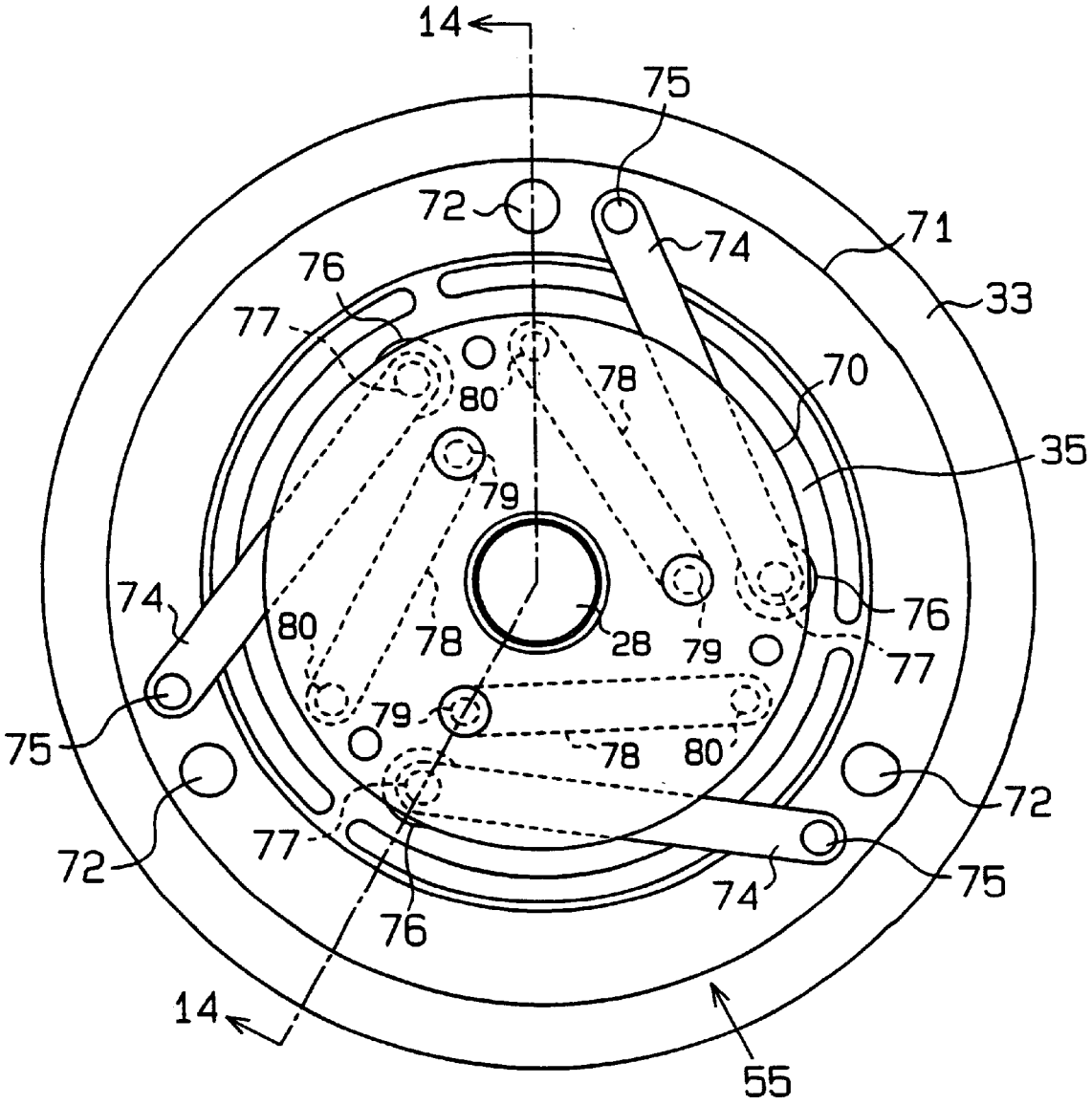
FIG. 15 is a front view showing the dynamic damper of FIG. 14.

FIGS. 14 and 15 show a damper 55 according to a seventh embodiment. The damper 55 includes an armature 35, which functions like the friction plate 56 in the damper 55 of FIGS. 1 and 2, and a ring-shaped weight 71. A friction surface 71*a* of the weight 71 contacts a friction surface 35*a* of the armature 35. The weight 71 includes equally spaced holes 71*b*. The axes of the holes 71*b* define a circle, the center of which coincides with the axis of the weight 71. A pin 72 having a head 72*a* is loosely fitted in each hole 71*b* from the front side of the damper 55. The rear end of each pin 72 is screwed to the armature 35. A coil spring 73 extends between the head 72*a* of each pin 72 and the weight 71. The springs 73 press the friction surface 71*a* of the weight 71 against the friction surface 35*a* of the armature 35. As shown in FIG. 15, leaf springs 74 are located between the weight 71 and the armature 35. Each leaf spring 74 has two ends. One of the ends is coupled to the front face of the weight 71 by a pin 75 and the other end is coupled to the front face of the armature 35 by a pin 77 with a spacer 76 in between. The leaf springs 74 elastically couple the weight 71 with the armature 35. The springs 74 are angularly spaced apart at equal intervals about the axis of the armature 35.

As shown in FIGS. 14 and 15, the inner hub 34 includes a cylindrical wall 34*a* extending forward in its center. A coupler plate 70 is secured to the cylindrical wall 34*a*. One end of each leaf spring 78 is coupled to the plate 70 by a pin 79. The other end of each leaf spring 78 is coupled to the front face of the armature 35 by a pin 80. The leaf springs 78 transmit rotation of the armature 35 to the inner hub 34.

As in the dampers of FIGS. 1–13, torsional vibration of the rotating body 63 is attenuated by vibrations of the weight 71 in the damper 55 of FIGS. 14 and 15. Tilting of the weight 71 is prevented by pressing the weight 71 against the friction surface 35*a* of the armature 35. However, tilting of the weight 71 may be prevented by the engagement between the pins 72 and the holes 71*b*.

In the damper 55 of FIGS. 14 and 15, the springs 73 for urging the weight 71 against the friction surface 35*a* are independent from the springs 74 for coupling the weight 71 with the armature 35. The characteristics of the springs 73, 74, such as the modulus of elasticity, therefore may be independently determined.

Like the damper 55 of FIGS. 12 and 13, the damper 55 of FIGS. 14 and 15 does not couple the inner hub 34 with the armature 35, but is secured to the armature 35. The damper 55 of FIGS. 14 and 15 is therefore easily installed on the clutch 31 without hindering the function of the clutch 31.

Material other than magnetic material such as iron may be used for the weight 71. That is, the weight 71 may be made of non-magnetic material. The original function of the solenoid 36 is to attract the armature 35 to the pulley 33. However, if the weight 71 is made of magnetic material, exciting the solenoid 36 causes the weight 71 to be attracted to the armature 35, which affects the adherence between the armature 35 and the pulley 33. The electromagnetic force of the solenoid 36 therefore needs to be determined considering the attraction between the weight 71 and the solenoid 36.

Further, the frictional force between the weight 71 and the armature 35 is varied by changes in the magnitude of the electric current supplied to the solenoid 36, dimensional errors of the parts in the clutch 31 and errors produced by assembling the clutch 31. The frictional force between the weight 71 and the armature 35 greatly affects the vibration attenuation characteristics of the damper 55. In other words, changes in the frictional force may result in unsatisfactory attenuation of vibrations. Therefore, non-magnetic material is preferable for the weight 71 because it does not disturb the function of the clutch 31 and is advantageous for satisfactorily attenuating vibrations.

Figure 16:
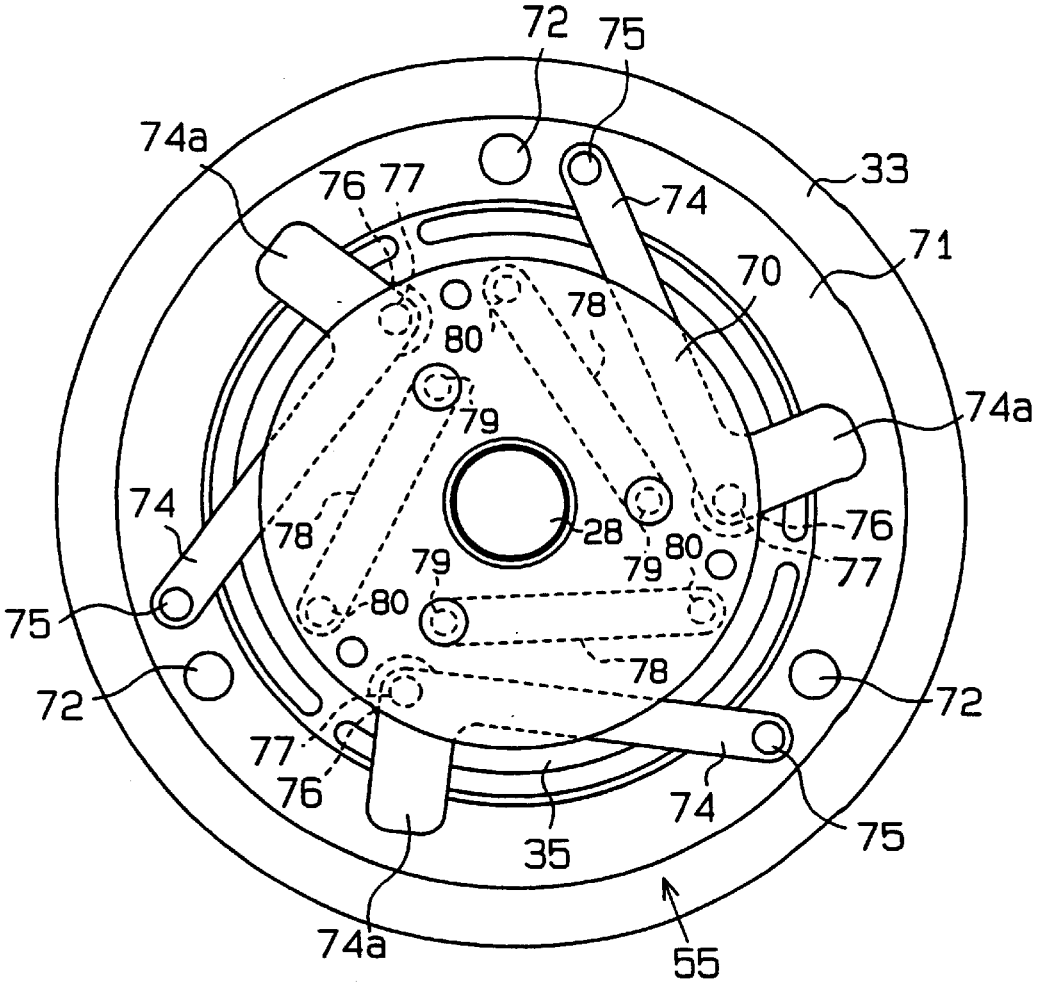
FIG. 16 is a front view showing a dynamic damper according to a eighth embodiment.

FIG. 16 shows a damper 55 according to an eighth embodiment. The damper 55 of FIG. 16 is a modification of the damper 55 of FIGS. 14 and 15. The damper 55 of FIG. 16 lacks the springs 73 that the damper 55 of FIGS. 14 and 15 has. Instead, each leaf spring 74 has a pressing portion 74*a* in the vicinity of the pin 77. The pressing portions 74*a* press the weight 71 against the friction surface 35*a* of the armature 35. Compared to the damper of FIGS. 14 and 15, the damper 55 of FIG. 16 has fewer parts.

Figure 17:
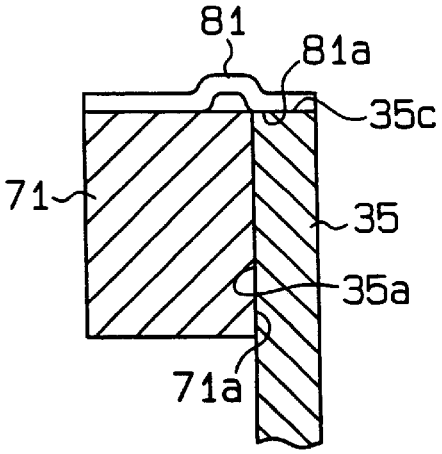
FIG. 17 is a front view showing a dynamic damper according to a ninth embodiment.

FIG. 17 shows a part of a damper according to a ninth embodiment. The damper of FIG. 17 is the same as the damper of FIGS. 14 and 15 except that the pins 72 and the coil springs 73 are omitted. Instead, the damper of FIG. 17 has leaf springs 81. The proximal end of each spring 81 is welded or otherwise fastened to the outer circumferential surface of the weight 71. A friction surface 81*a* is formed by the inner side of the distal portion of each spring 81. The friction surface 81*a* is pressed against a circumferential friction surface 35*c* of the armature 35. The number of the springs 81 is preferably three or greater. Otherwise, the construction of the damper of FIG. 17 is the same as the construction of the damper 55 of FIGS. 14 and 15.

The leaf springs 81 prevent the weight 71 from moving axially and also prevent the weight 71 from tilting relative to a plane perpendicular to the axis of the armature 35. The leaf springs 81 therefore allow the weight 71 to vibrate only about the axis of the armature 35. In a reversal of the damper of FIG. 17, the proximal end of each spring 81 may be secured to the circumferential surface of the armature 35, and the distal end of the spring 81 may be pressed against a circumferential friction surface formed on the weight 71.

Figure 18:
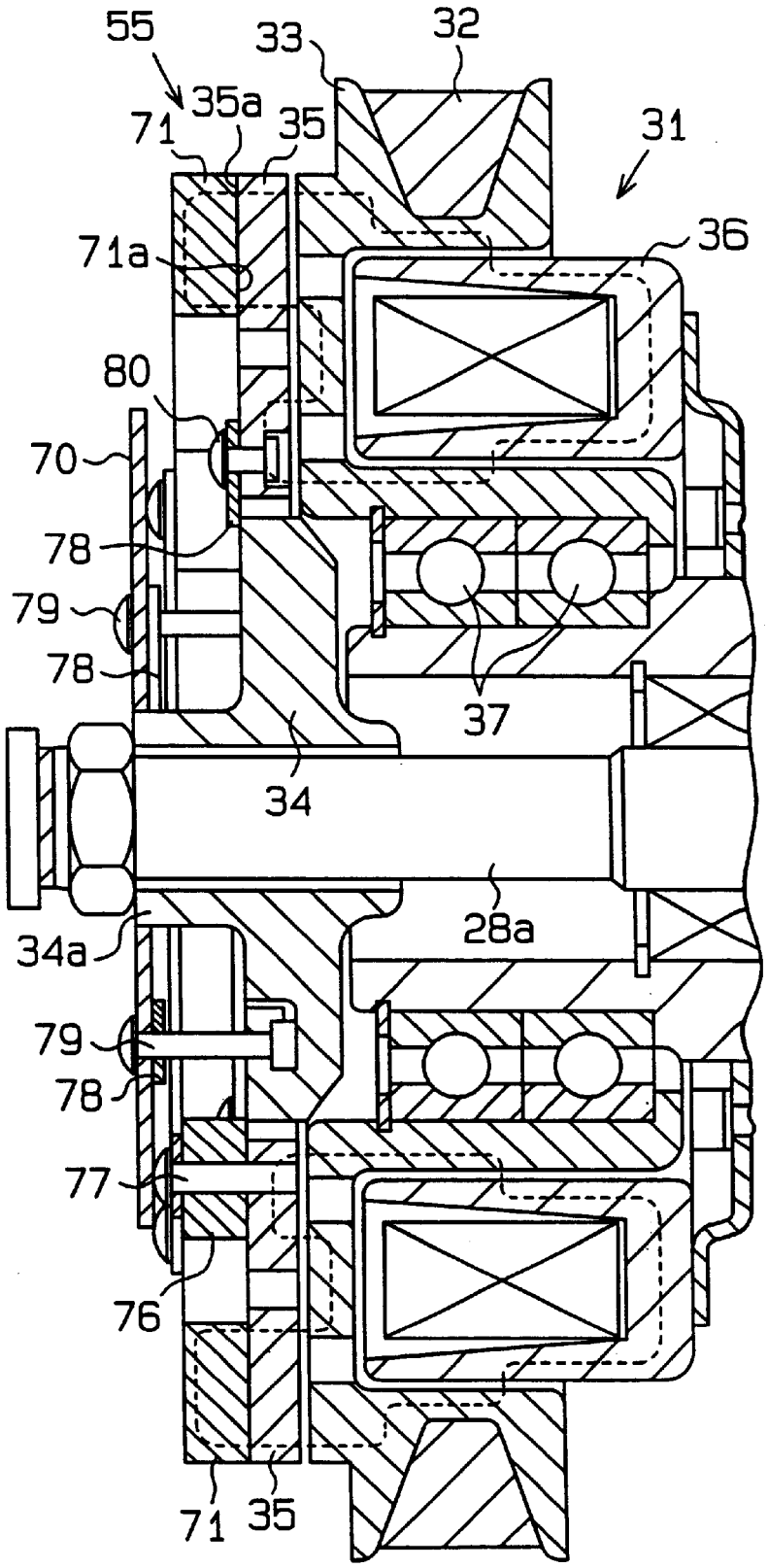
FIG. 18 is a cross-sectional view taken along line 18—18 of FIG. 19 showing a dynamic damper according to a tenth embodiment.
Figure 19:
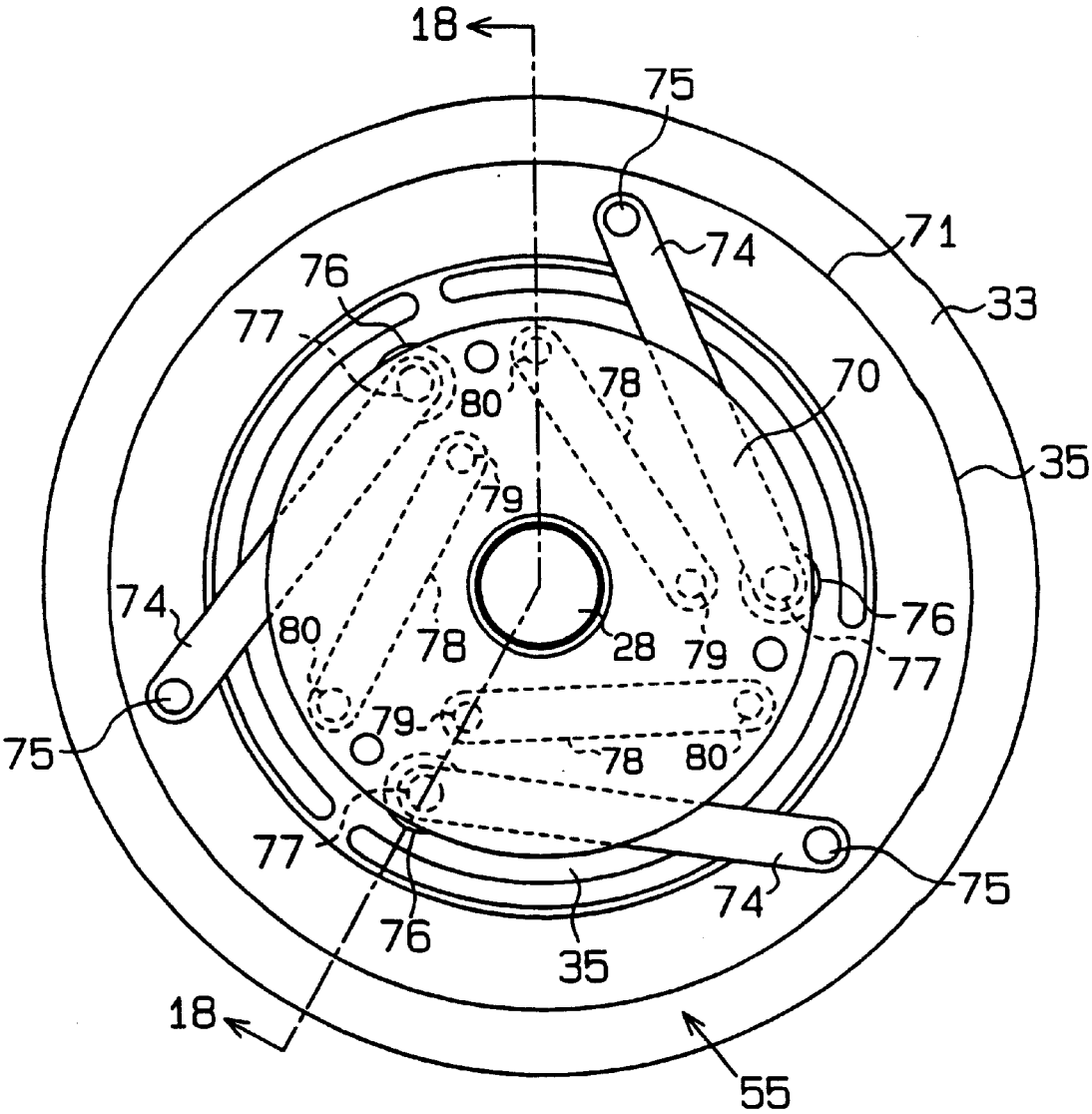
FIG. 19 is a front view showing the dynamic damper of FIG. 18.

FIGS. 18 and 19 shows a damper 55 according to a tenth embodiment. The damper 55 of FIGS. 18 and 19 is different from the damper 55 of FIGS. 14 and 15 in that the pins 72 and the springs 73 are omitted. Instead, the weight 71 is made of magnetic material. When the solenoid 36 is excited, the friction surface 71*a* of the weight 71 is attracted to the friction surface 35*a* of the armature 35. This construction reduces the number of the parts in the damper 55.

Figure 20:
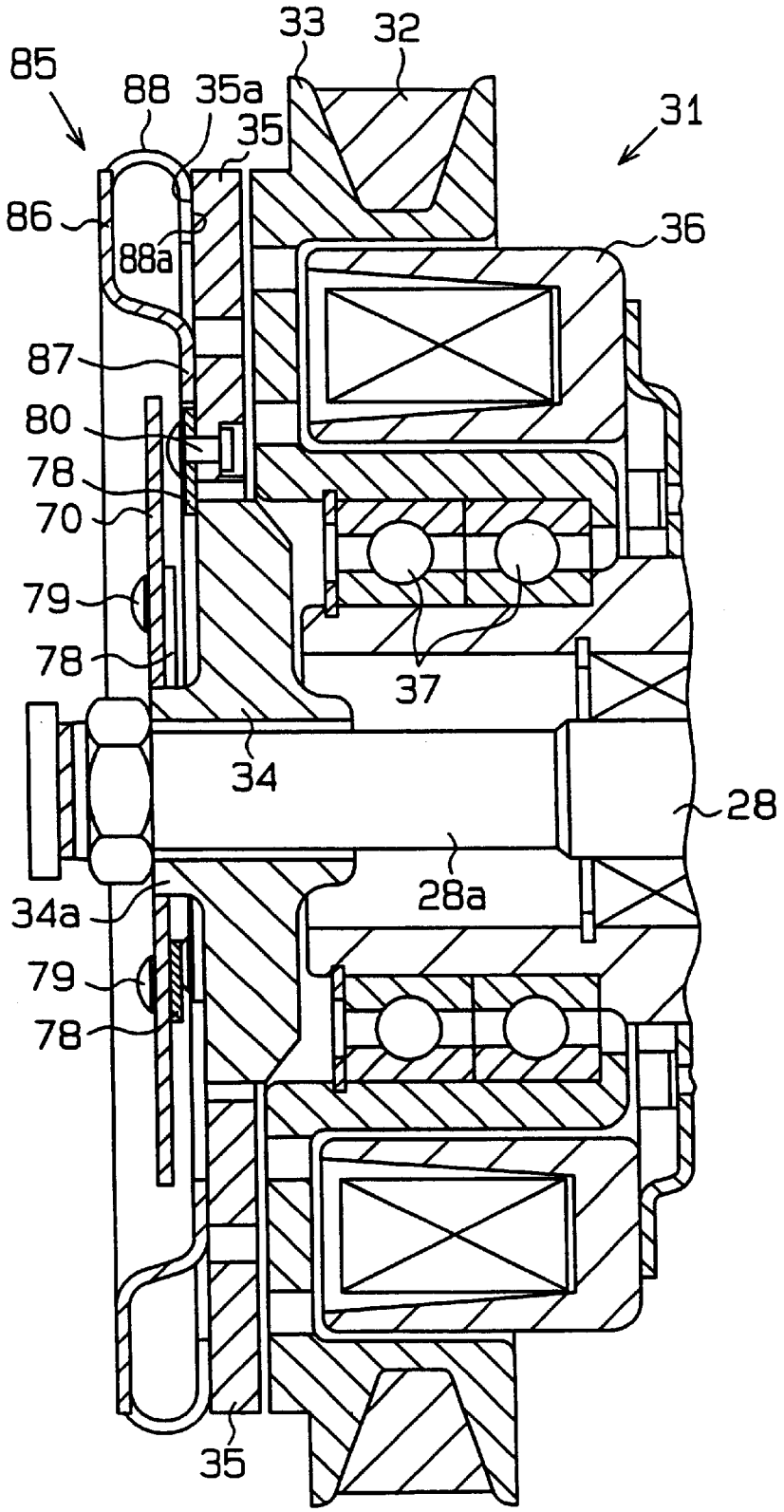
FIG. 20 is a cross-sectional view taken along line 20—20 of FIG. 21 showing a dynamic damper according to an eleventh embodiment.
Figure 21:
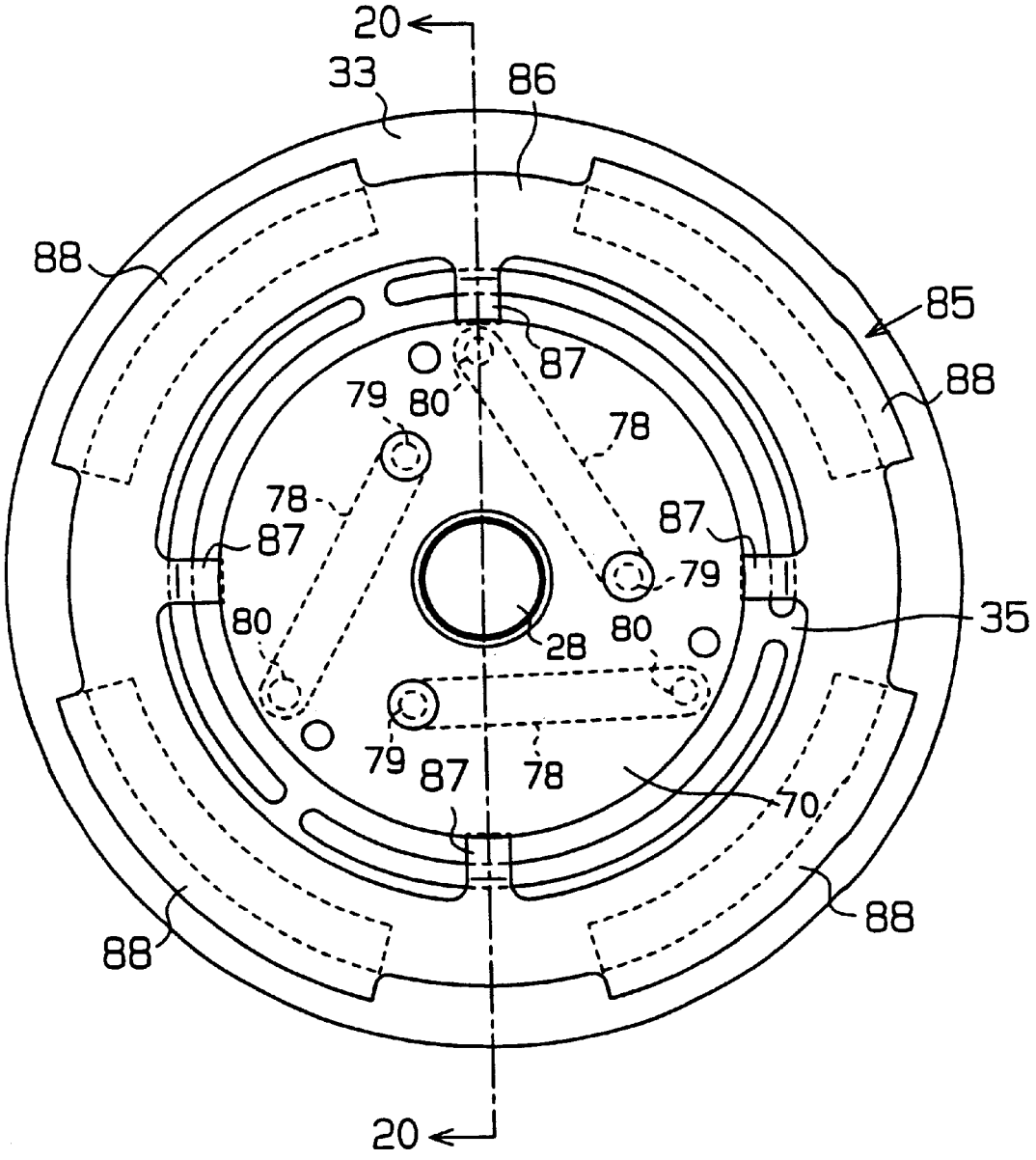
FIG. 21 is a front view showing the dynamic damper of FIG. 20.

FIGS. 20 and 21 show an integrated dynamic damper 85 according to an eleventh embodiment. The dynamic damper 85 is secured to the armature 35. The damper 85 is manufactured by bending a metal plate. The damper 85 includes a ring-shaped weight 86 and leaf springs 87, which are integrally formed with the weight 86 and extend inward. The number of the springs 87 is, for example, four. The leaf springs 87 are secured to the front face of the armature 35 for elastically coupling the weight 86 with the armature 35. The damper 85 also has pressing portions 88. Each pressing portion 88 has a friction surface 88*a* pressed against the friction surface 35*a* of the armature 35. In this manner, the damper 85 is formed by a single plate. The damper 85 therefore has a simple structure and is easy to manufacture.

Figure 22:
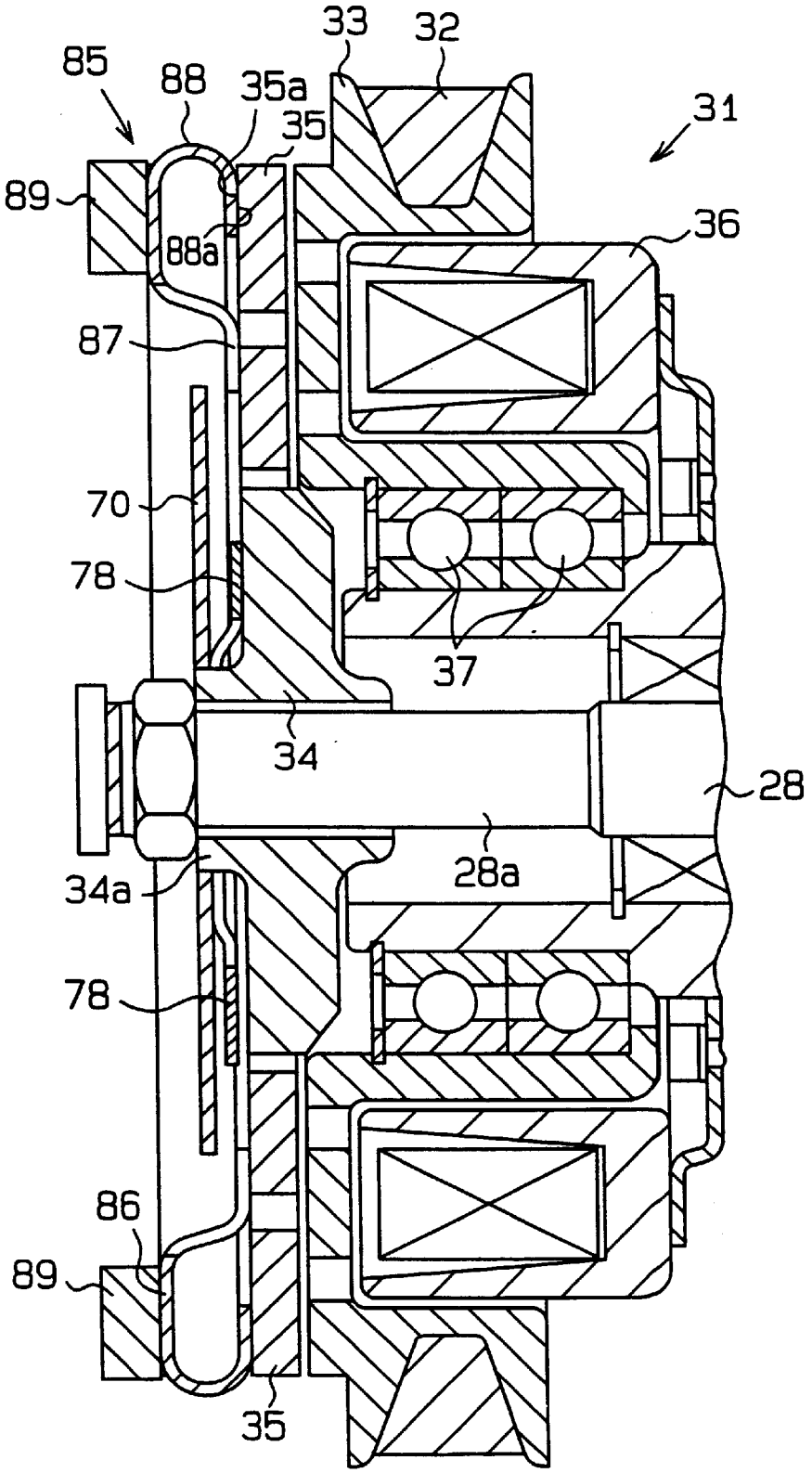
FIG. 22 is a cross-sectional view taken along line 22—22 of FIG. 23 showing a dynamic damper according to a twelfth embodiment.
Figure 23:
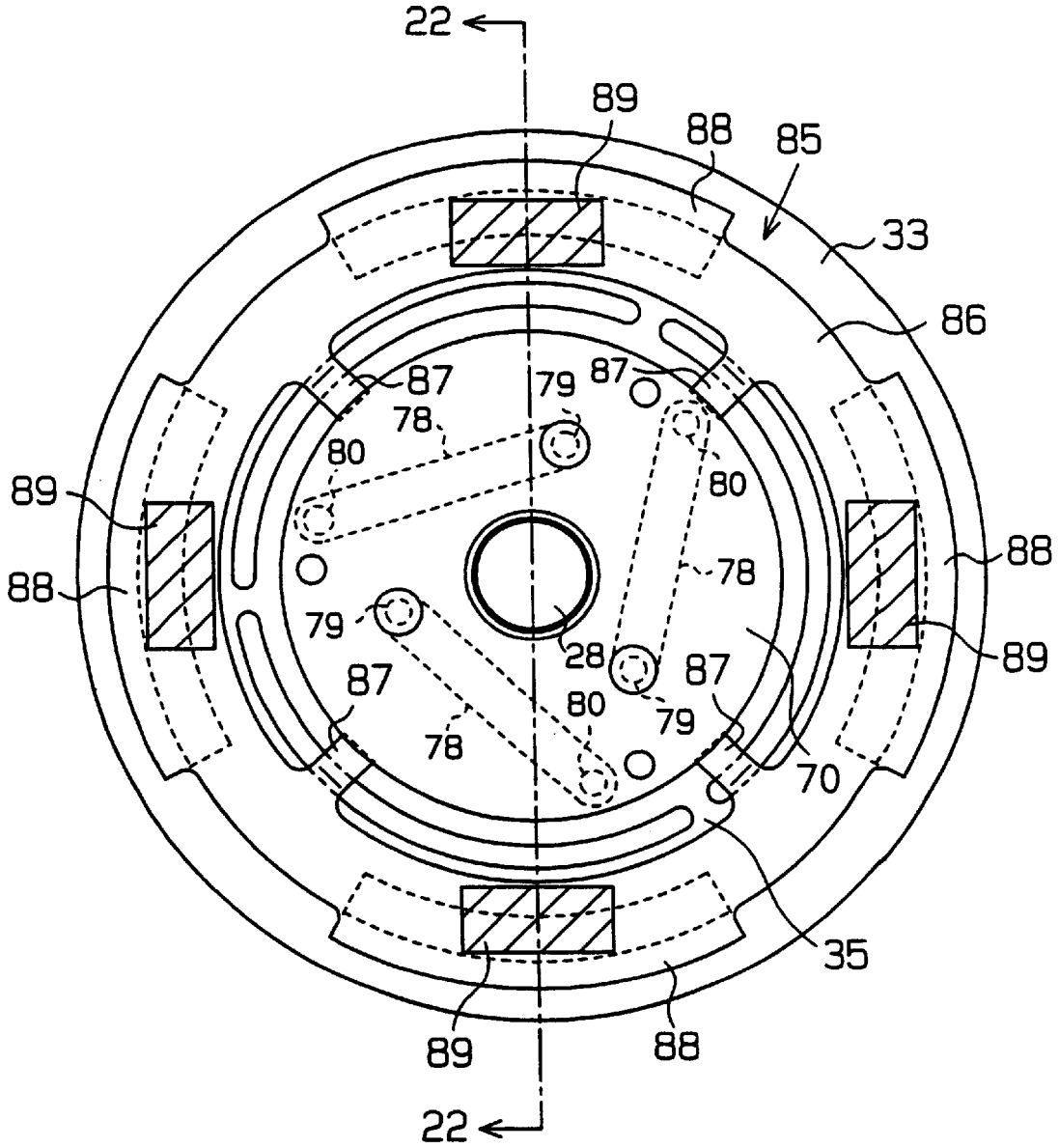
FIG. 23 is a front view showing the dynamic damper of FIG. 22.

FIGS. 22 and 23 show a damper 85 according to a twelfth embodiment. The damper 85 of FIGS. 22 and 23 is different from the damper of FIGS. 20 and 21 in that separate weights 89, the number of which is, for example, four, are secured to the front face of the weight 86. The damper 85 of FIGS. 22 and 23 attenuates torsional vibrations more effectively compared to the damper of FIGS. 20 and 21.

Figure 24:
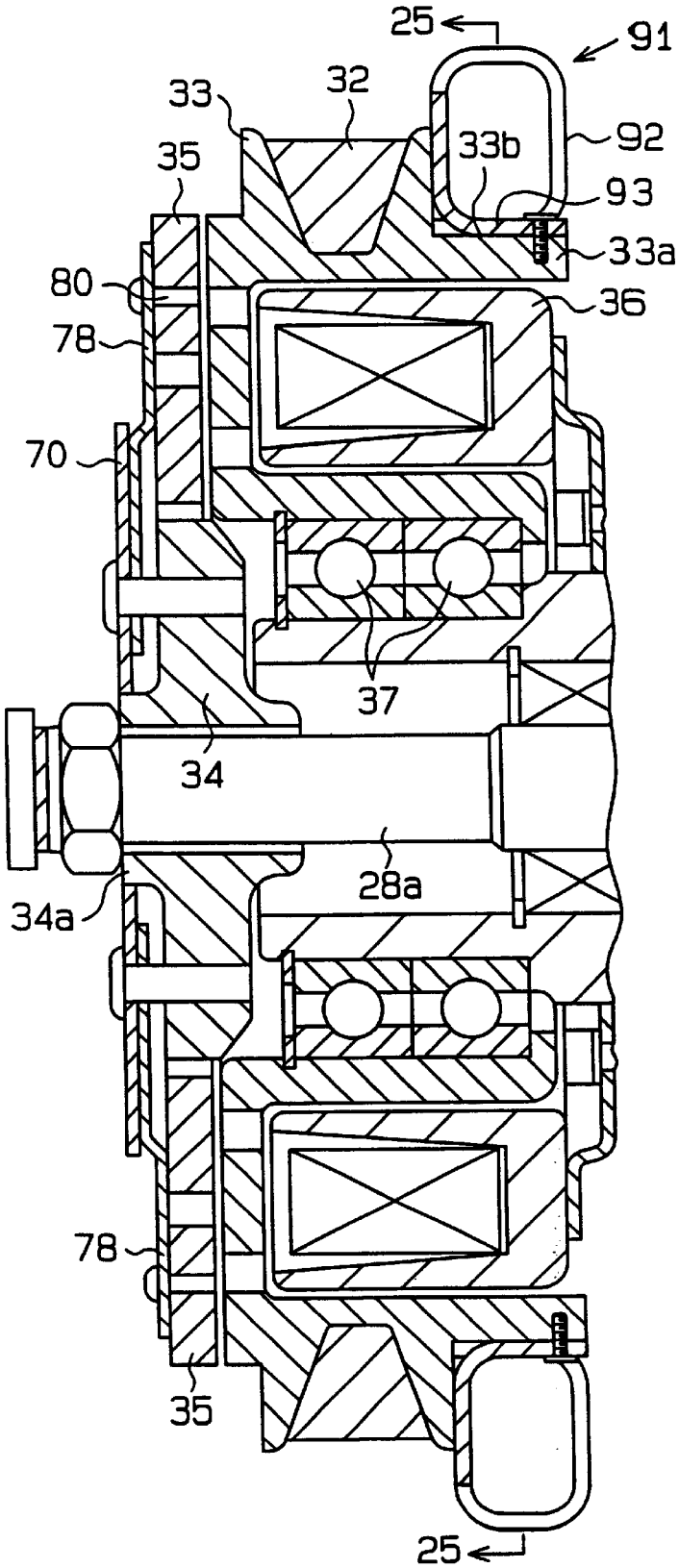
FIG. 24 is a partial cross-sectional view showing a dynamic damper according to a thirteenth embodiment.
Figure 25:
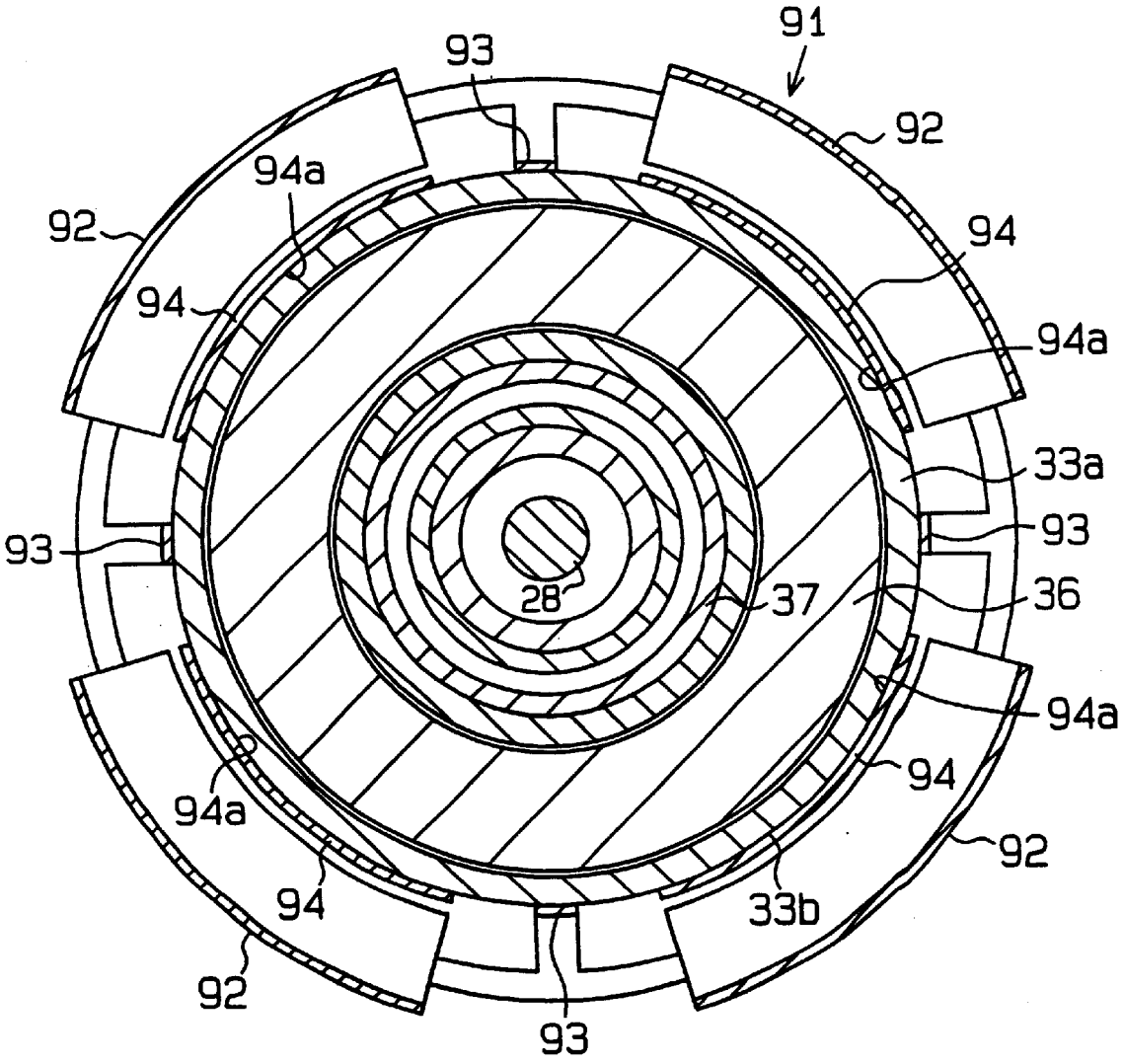
FIG. 25 is a cross-sectional view taken along line 25—25 of FIG. 24.
Figure 26:
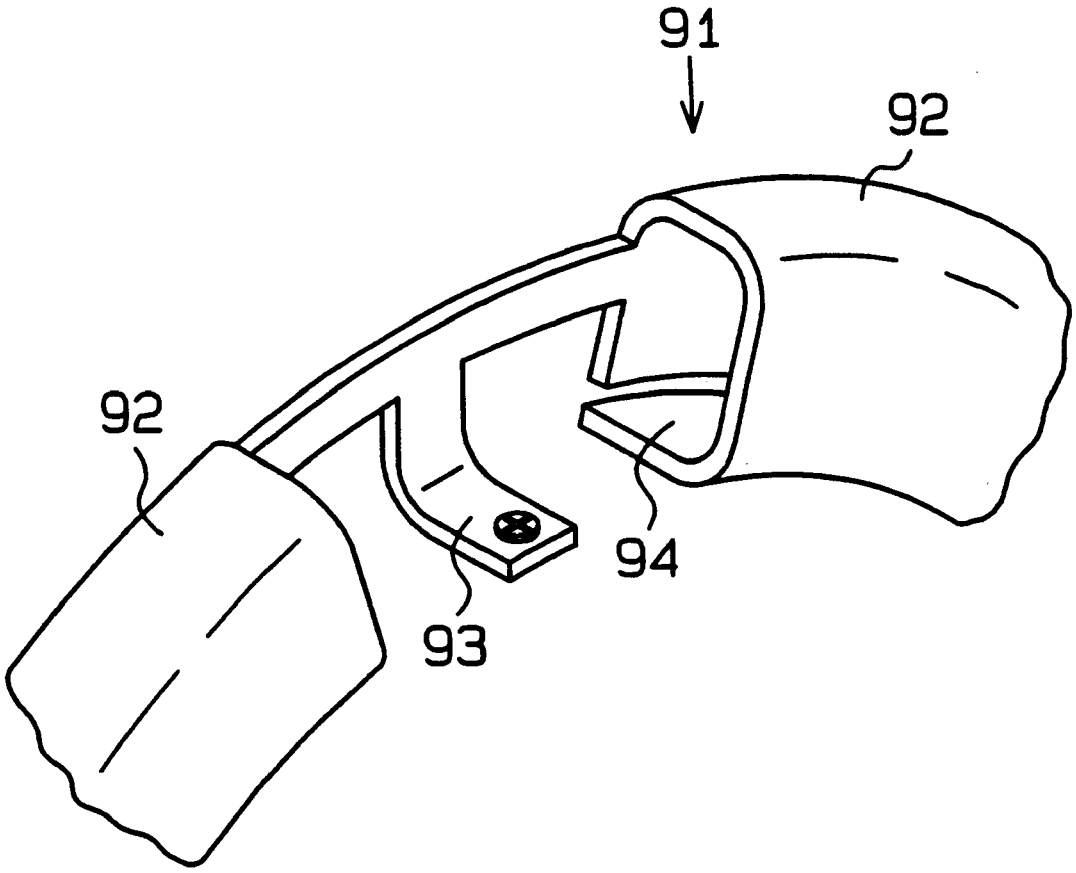
FIG. 26 is a partial perspective view showing the dynamic damper of FIGS. 24 and 25.

FIGS. 24–26 show a ring-shaped dynamic damper 91 according to a thirteenth embodiment. The damper 91 is secured to a pulley 33. The pulley 33 has a cylindrical wall 33*a* extending rearward. The damper 91 is fitted about the cylindrical wall 33*a*. The damper 91 is manufactured by bending a single metal plate. The damper 91 includes tube-like weights 92, the number of which is four in the embodiment of FIGS. 24–26. Each weight 92 has a substantially rectangular cross-section. Each pair of adjacent weights 92 are connected by a leaf spring 93. The leaf springs 93 elastically couple the weights 92 to the pulley 33. The inner wall of each weight 92 forms an arcuate pressing portion 94, which acts like a spring. Each pressing portion 94 includes a friction surface 94*a*, which is pressed against a circumferential friction surface 33*b* of the cylindrical wall 33*a*. In this manner, the damper 91 is formed by a single plate. The damper 91 therefore has a simple structure and is easy to manufacture.

The illustrated embodiments may be modified as follows.

The present invention may be embodied in compressors other than the compressor of FIG. 1. For example, the present invention may be embodied in a single-headed piston type compressor, a variable displacement compressor, a wave cam plate type compressor, a vane compressor or a scroll type compressor.

The clutch 31 may be omitted and power of the engine E may be constantly transmitted to the drive shaft 28. If the clutch 31 is omitted, the present invention is preferably embodied in a variable displacement compressor. In this case, the pulley 33 is directly coupled to the drive shaft 28 or is coupled to the drive shaft 28 by the inner hub 34. A damper according to the present invention is secured to at least one of the drive shaft 28, the pulley 33 and the inner hub 34.

Therefore, the present examples and embodiments are to be considered as illustrative and not restrictive and the invention is not to be limited to the details given herein, but may be modified within the scope and equivalence of the appended claims.

What is claimed is:

1. A compressor having a damper for attenuating torsional vibrations, the compressor having a rotating body, which includes an integrally rotating drive shaft, and a compressing member driven by the rotating body to compress fluid, which causes torsional vibrations of the rotating body, wherein the damper attenuates the torsional vibrations of the rotating body, the damper comprising:

a frictional member provided on the rotating body to integrally rotate with the rotating body, wherein the frictional member has a frictional surface;

a weight having a frictional surface, wherein the frictional surface of the weight contacts the frictional surface of the frictional member to create a predetermined frictional torque resistance between the weight and the frictional member; and a coupler to elastically connect the weight to one of the rotating body and the frictional member for transmitting rotation and torsional vibrations of the rotating body to the weight, wherein the coupler has elasticity in the direction of the torsional vibrations, and wherein the weight contacts the frictional member and vibrates about the axis of the rotating body to cancel the torsional vibrations of the rotating body.

2. The compressor according to claim 1, wherein the weight is supported to resist tilting relative to a plane perpendicular to the axis of the rotor.

3. The compressor according to claim 2, wherein the frictional surface of the frictional member lies in a plane perpendicular to the axis of the rotor.

4. The compressor according to claim 1, wherein the damper further includes a pressing member for elastically pressing the weight against the frictional member.

5. The compressor according to claim 4, wherein the coupler comprises a coil spring or a leaf spring that also functions as the pressing member.

6. The compressor according to claim 1, wherein the drive shaft includes a first end located in the compressor and a second end located outside of the compressor, and wherein the damper is provided on one of the ends.

7. The compressor according to claim 6, wherein the frictional member is fixed to the drive shaft, wherein the weight is supported by the drive shaft to be rotatable relative to the drive shaft, wherein the coupler comprises a spring that connects the weight to one of the drive shaft and the frictional member, and wherein the spring elastically presses the weight against the frictional member.

8. The compressor according to claim 1, further comprising a housing for rotatably supporting the drive shaft, wherein the housing defines a suction chamber, a compression chamber and a discharge chamber, and wherein the compression member draws fluid from the suction chamber into the compression chamber, discharges fluid compressed in the compression chamber to the discharge chamber, and wherein the damper is located in the suction chamber.

9. The compressor according to claim 6, wherein the damper includes a case for housing the weight, wherein the case functions as the frictional member, and wherein the coupler is a spring that connects the weight to the case.

10. The compressor according to claim 1, wherein the weight is shaped like an impeller.

11. The compressor according to claim 1, wherein the rotor includes a clutch located between an external drive source and the drive shaft, wherein the clutch selectively connects the external drive source with the drive shaft, and wherein the damper is provided on the clutch.

12. The compressor according to claim 11, wherein the clutch includes a portion that functions as the frictional member, and wherein the coupler couples the weight with the portion.

13. The compressor according to claim 11, wherein the clutch includes a pulley connected to the external drive source, an inner hub secured to the drive shaft, an armature facing the pulley and supported by the inner hub to integrally rotate with the inner hub, and a solenoid for causing the armature to contact and to separate from the pulley based on electromagnetic force, and wherein the damper is provided on the pulley or on the armature.

14. The compressor according to claim 13, wherein the coupler couples the weight with the frictional member, which comprises the pulley or the armature.

15. The compressor according to claim 14, wherein the armature functions as the frictional member, and wherein the damper includes a pressing member for elastically pressing the weight against the armature.

16. The compressor according to claim 15, wherein the coupler comprises a leaf spring that also functions as the pressing member.

17. The compressor according to claim 15, wherein the coupler comprises a leaf spring, and wherein the pressing member comprises a coil spring.

18. The compressor according to claim 15, wherein the weight is made of non-magnetic material.

19. The compressor according to claim 14, wherein the armature functions as the frictional member, wherein the weight is made of magnetic material, and wherein, when the solenoid is excited, the weight is attracted to the armature.

20. The compressor according to claim 14, wherein the armature functions as the frictional member, wherein the armature and the weight each have a circumferential surface, and wherein the damper includes a friction member provided on one of the circumferential surfaces for elastically pressing the other one of the circumferential surfaces.

21. The compressor according to claim 14, wherein the coupler is integrally formed with the weight.

22. The compressor according to claim 21, wherein the weight includes an integrally formed pressing member for elastically pressing the friction surface of the weight against the pulley or against the armature.

23. The compressor according to claim 22, wherein the damper comprises an annular member, which is formed by bending a plate.

* * * * *